United States Patent [19]

Philip

[11] 4,015,447

[45] Apr. 5, 1977

[54] METHOD AND APPARATUS FOR POSITIVELY FEEDING YARN

[76] Inventor: Morris Philip, 2519 Grand Ave., Bronx, N.Y. 10468

[22] Filed: Jan. 3, 1975

[21] Appl. No.: 538,268

[52] U.S. Cl. ..... 66/132 R; 226/182; 242/47.01

[51] Int. Cl.[2] ..... D04B 15/48

[58] Field of Search ..... 66/132 T, 132 R; 242/47.01, 155 R, 150 R; 226/184, 34, 182; 74/230.17 R

[56] References Cited

UNITED STATES PATENTS

| | | | |
|---|---|---|---|
| 103,643 | 5/1870 | Mooney | 242/150 |
| 656,428 | 8/1900 | Sherd | 242/150 |
| 1,420,530 | 6/1922 | Drumheller | 66/132 R |
| 1,562,829 | 11/1925 | Howie | 66/132 R |
| 2,080,893 | 5/1937 | Klein | 242/150 |
| 2,089,494 | 8/1937 | Lawson | 66/132 R |
| 2,099,178 | 11/1937 | Snyder | 66/132 R |
| 2,333,705 | 11/1943 | Cooper | 66/132 R |
| 2,583,568 | 1/1952 | Heizer | 66/132 R |
| 2,887,893 | 5/1959 | Claas | 74/230.17 R |
| 3,154,260 | 10/1964 | Stanislao et al. | 242/47.01 |
| 3,347,436 | 10/1967 | Grassman | 226/182 |
| 3,361,317 | 1/1968 | Levin | 66/132 T |
| 3,675,446 | 7/1972 | Cooke | 66/132 T |
| 3,800,564 | 4/1974 | Carswell | 66/132 R |
| 3,836,120 | 9/1974 | Niskin | 226/182 |
| 3,862,711 | 1/1975 | Smith et al. | 66/132 R |
| 3,907,189 | 9/1975 | Griffith | 226/182 |

FOREIGN PATENTS OR APPLICATIONS

| | | | |
|---|---|---|---|
| 217,552 | 5/1957 | Australia | 66/132 R |
| 824,843 | 2/1938 | France | 66/132 R |
| 543,338 | 5/1956 | Italy | 74/230.17 R |
| 109,993 | 8/1960 | Pakistan | 74/230.17 R |
| 861,879 | 3/1961 | United Kingdom | 66/132 R |
| 603,308 | 6/1948 | United Kingdom | 66/132 R |
| 6,379 | 3/1903 | United Kingdom | 74/230.17 R |
| 758,055 | 9/1956 | United Kingdom | 242/155 R |
| 916,348 | 1/1963 | United Kingdom | 74/230.17 R |

*Primary Examiner*—Mervin Stein
*Assistant Examiner*—Andrew M. Falik

[57] ABSTRACT

A plurality of yarn feeding assemblies are mounted about a circular multifeed knitting machine. Each assembly comprises a U-shaped hanger bracket and a shaft is rotatably mounted in the arms of the bracket. On each shaft one or more yarn feeding units are mounted for rotation therewith about the shaft axis. Each unit is comprised of a pair of toothed wheels, one of the wheels being fixed to the shaft and the other one being axially movable along said shaft in order to vary the spacing the wheels. Means are provided for selectively varying the spacing between the front faces of the wheels. Each wheel is constituted by a plurality of radially extending circumferentially spaced apart ribs, the front faces of the ribs of one wheel facing the front faces of the ribs of the other wheel. The ribs of each wheel are receivable within the spaces between the ribs of the other wheel. The front faces of the ribs of the fixed wheel are substantially perpendicular to the axis of the shaft and the front faces of the ribs of the movable wheel are rearwardly and outwardly inclined relative to the axis. The edges of the front faces cooperate to produce outwardly opening bites. A yarn guide holder is mounted on the bracket for directing yarn from a yarn source into the bites of the yarn unit, around at least a portion of the unit, and then toward a knitting station. A feed unit is provided for each knitting station. The shafts are rotated synchronously with the knitting machine and the rate of feeding for each feed unit may be varied by varying the axial spacing between the wheels thereof.

21 Claims, 13 Drawing Figures

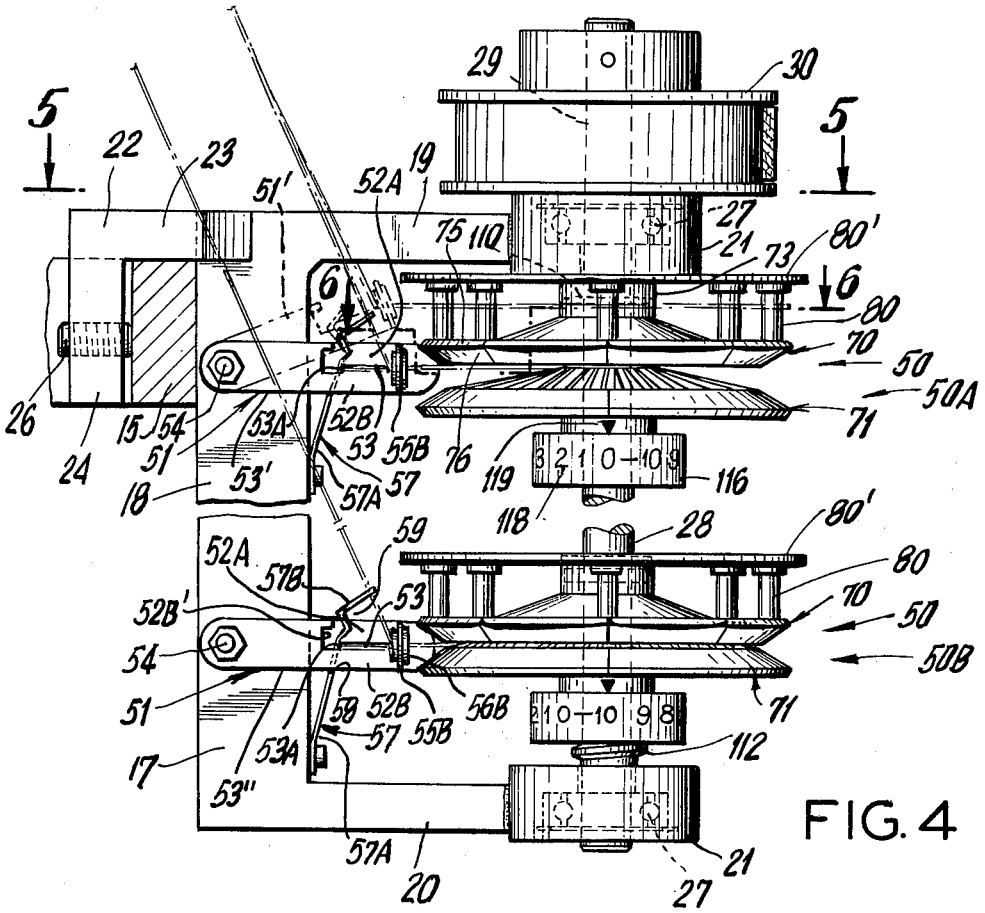
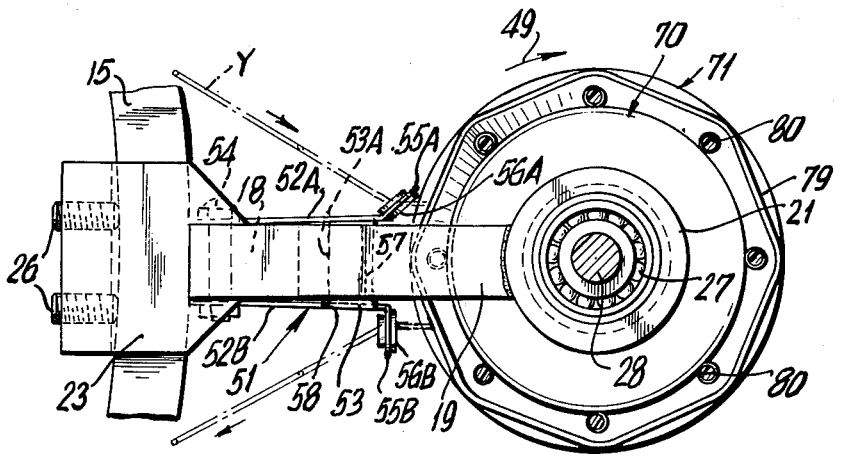
FIG. 5

METHOD AND APPARATUS FOR POSITIVELY FEEDING YARN

BACKGROUND OF THE INVENTION

1. Field of the Invention

The present invention relates to method and apparatus for positively feeding yarns of indefinite lengths from a yarn source to a knitting machine or the like.

2. Description of the Prior Art

In the present state of the knitting art, particularly when using multifeed circular knitting machines, it is highly desirable to interpose a positive feeding device between the yarn supply and the knitting stations of the machine, said positive feeding device drawing the yarn from the yarn supply and directing it to its respective knitting station at substantially the rate the knitting station consumes the yarn. In the absence of such a device, the consumption of the yarn at the knitting station would draw the yarn from the supply. The reasons why the use of positive feeding devices are desirable are well known in the art and need not be further discussed herein. Many positive feeding devices have been proposed and some are being used commercially, but such devices have various deficiencies.

One type of positive feeding device in relatively widespread commercial use is that generally described in Rosen U.S. Pat. Nos. 3,090,215 and 3,243,091, frequently called a Rosen type. This device has a plurality of circumferentially spaced apart idler rollers mounted above the knitting machine, said rollers being driven by a yarn feeding endless tape trained around the rollers, the tape being driven by the knitting machine drive. There is one roller for each knitting station and the yarn corresponding to that station is directed between the periphery of the corresponding roller and the contacting surface of the tape. Rotation of the tape causes the roller to rotate, the mating surfaces of the tape and roller frictionally engaging the yarn therebetween to draw the yarn from the supply and direct it toward the knitting station.

There are two principal shortcomings of the Rosen tape. The yarn frequently slips between the mating surfaces of the tape and roller, with the result that the yarn is not delivered at the desired rate. Furthermore, a Rosen type cannot provide different rates of feeding for different knitting stations. The rate of feeding depends upon the lineal speed of the mating surfaces of the tape and roller. The lineal speed of these mating surfaces is determined by the lineal speed of the tape and is independent of the diameter of the rollers. Since a plurality of rollers are driven by a single tape, all of the rollers must feed their respective yarns at the same rate, even if the rollers have different diameters. In order for some yarns to be delivered at a rate different from other yarns, it is necessary to have, for each rate of delivery, a separate Rosen tape with its own set of rollers. It is rare to have more than two or three Rosen tapes on a machine because of mechanical and space problems, as well as cost problems. It is impossible to independently select the feeding rate for each knitting station fed by that tape.

U.S. Pat. No. 3,361,317 to Levi discloses a positive feeding device which also utilizes a plurality of circumferentially spaced apart rollers driven by an endless belt trained about the rollers, the rollers having a projecting peripheral portion not contacted by the belt. The yarn being fed is directed around the projecting portion and is fed by the frictional engagement between the surface of the projecting portion and the yarn. Although the projecting portion may be covered with friction material to reduce yarn slippage, slippage does occur since the yarn is not positively gripped between opposed surfaces. The rate of delivery depends upon the lineal speed of the surface of the projecting roller portion. Therefore, by providing rollers whose projecting portions have different diameters, it is possible to obtain different rates of feeding for different knitting stations, although the patent has no such suggestion of simulataneously providing different feeding rates. In order to change the rate of delivery of a particular roller, it would have to be replaced by another roller and this is a cumbersome operation.

U.S. Pat. No. 2,708,841 to Lumsden discloses an apparatus for feeding elastic rubber yarns. The apparatus utilizes a plurality of driven pulleys comprising interlaced fingers, the fingers being at an angle to the plane of the pulley to provide a type of V-grooved pulley. Although these pulleys may be adequate for feeding rubber yarn because of the surface friction characteristics of the yarn, the fingers are so circumferentially spaced apart that ordinary yarns will slip. The pulleys are not adjustable for providing different rates of delivery.

It has also been suggested to provide positive feeding devices which comprise pairs of meshing gears of various shapes. The yarn passes between the opposed surfaces of the meshing gears and rotation of the gears causes the yarn to be fed. Such constructions not only permit slippage but the opposed surfaces of the gears can easily damage the yarn by crushing or tearing it.

SUMMARY OF THE INVENTON

The present invention is directed to method and apparatus which avoid the shortcomings of the prior art, particularly the shortcomings of the commercially used devices. As pointed out above, one of the serious problems of the prior art is the slippage of the yarn relative to those surfaces of the feeding devices which feed the yarn. As a result of such slippage, the rate of feeding of the yarn cannot be accurately adjusted and controlled throughout the knitting process. Briefly, according to the present invention, slippage is avoided by wedgingly gripping the yarn in bites moving downstream along the yarn course, the movement of the bites positively feeding the yarn without slippage or damage to the yarn. In the illustrated and preferred embodiments, such bites are scissors-like bites formed by opposed teeth intersecting each other at an angle.

Another problem not successfully solved in the prior art is the problem of independently adjusting the rate of feeding the yarn for each yarn feed or knitting station. This is a particularly serious problem when knitting jacquard patterns because many different rates of feeding are required for many of the yarn feeds. For example, when knitting with a 72 feed jacquard machine, it is possible to design a pattern which would require a different rate of feeding for each feed. Frequently, patterns knit on a 72 feed machine may require 24 different rates of feeding or even more. Since the prior art devices cannot simultaneously supply so many rates of feeding, jacquard patterns are knit with positive feeding being used for only some of the feeds. Although the modification suggested above in connection with U.S. Pat. No. 3,361,317 can provide a different rate of feeding for each knitting station, such modification would be highly impractical, since it would require a supply of rollers for each rate of feeding. Furthermore, since the diameters of the projecting portions determine the rate of feeding, the diameters for different rates of feeding would differ by finite amounts, so that provision cannot be made for varying the rate of feeding over a continuous range.

The present invention overcomes the shortcomings discussed in the previous paragraph by providing a feed unit for each yarn feed, with the rate of feeding of each unit being independently adjustable relative to the other feed units. Furthermore, according to the preferred form of the invention, each feed unit is adjustable through a continuous feeding range, so that any desired rate of feeding can be obtained, regardless of how little such rate differs from another rate.

According to one aspect of the invention, there is provided a methiod of positively feeding yarn of indefinite length from a yarn source to a knitting machine or the like comprising the steps of: (a) extending said yarn in the yarn course from a yarn source to said machine; (b) repeatedly performing the operations of (1) wedging said yarn at a first location in said yarn course into at least one scissors-like bite to grip the yarn thereby, (2) moving said bites with said yarn gripped thereby downstream along said yarn course to draw said yarn from said source and to convey said yarn downstream through a portion of said course, and (3) releasing said yarn from said bites at a location in said course downstream from said first location (c) said repeated operations overlapping so that said yarn is being continuously gripped and conveyed by at least one bite to continuously maintain the movement of the yarn under the control of said bites, whereby said yarn is positively fed by said moving bites; (d) said bites, during said movement, being moved synchronously with the operation of said machine.

According to another aspect of the invention, there is provided an apparatus for positively feeding yarn of indefinite length from a yarn source to a knitting machine or the like comprising: (a) at least one yarn feed unit comprising a first toothed member and a second toothed member, each member having an axis and a front face; (b) each said front face comprising a plurality of circumferentially spaced apart forwardly facing operative yarn engaging teeth disposed about said axis; (c) said teeth of said first member being mechable with said teeth of said second member to position each said tooth of each member in cooperative relationship with at least one adjacent tooth of the other member for positively feeding yarn positioned therebetween; (d) means for coaxially mounting said members with said front faces opposed and said teeth meshing to provide an assembled yarn feed unit rotatable about the common axis of said members and for selectively varying the axial spacing between said members of said assembled unit at least through a selected range of axial spacing; (e) means for rotating said assembled unit about said axis; (f) said teeth of said assembled unit meshing at least in an annular zone of said assembly at least through said range of axial spacing; (g) each of said teeth, at least in said annular zone, being outwardly and rearwardly inclined relative to each adjacent tooth cooperative therewith to cause each of said teeth to intersect each tooth cooperative therewith, at least through said range of axial spacing, at an outwardly opening angle to provide an outwardly opening substantially V-shaped circumferential groove around said assembled unit, the diameter of the root of said groove increasing as the axial spacing between said members decreased, and vice versa; and (h) means for directing said yarn from said source into said groove and around at least a portion thereof, and then out of said groove toward said machine; (i) whereby when said assembled unit is rotated, said cooperating teeth engage the yarn in the groove to draw the yarn from the source and positively feed the yarn toward the machine.

The foregoing, as well as other aspects of the invention, will be readily apparent from the following description.

BRIEF DESCRIPTION OF THE DRAWINGS

In the accompanying drawings.

FIG. 4 is an enlarged view of one of the yarn folding units of FIG. 1, with parts being broken away. This figure shows in detail one embodiment of the device according to the invention. The embodiment shown therein is approximately the size of an actual prototype:

FIG. 5 is a vertical section taken along the line 5—5 of FIG. 4;

DESCRIPTION OF THE PREFERRED EMBODIMENT

Figure 1:
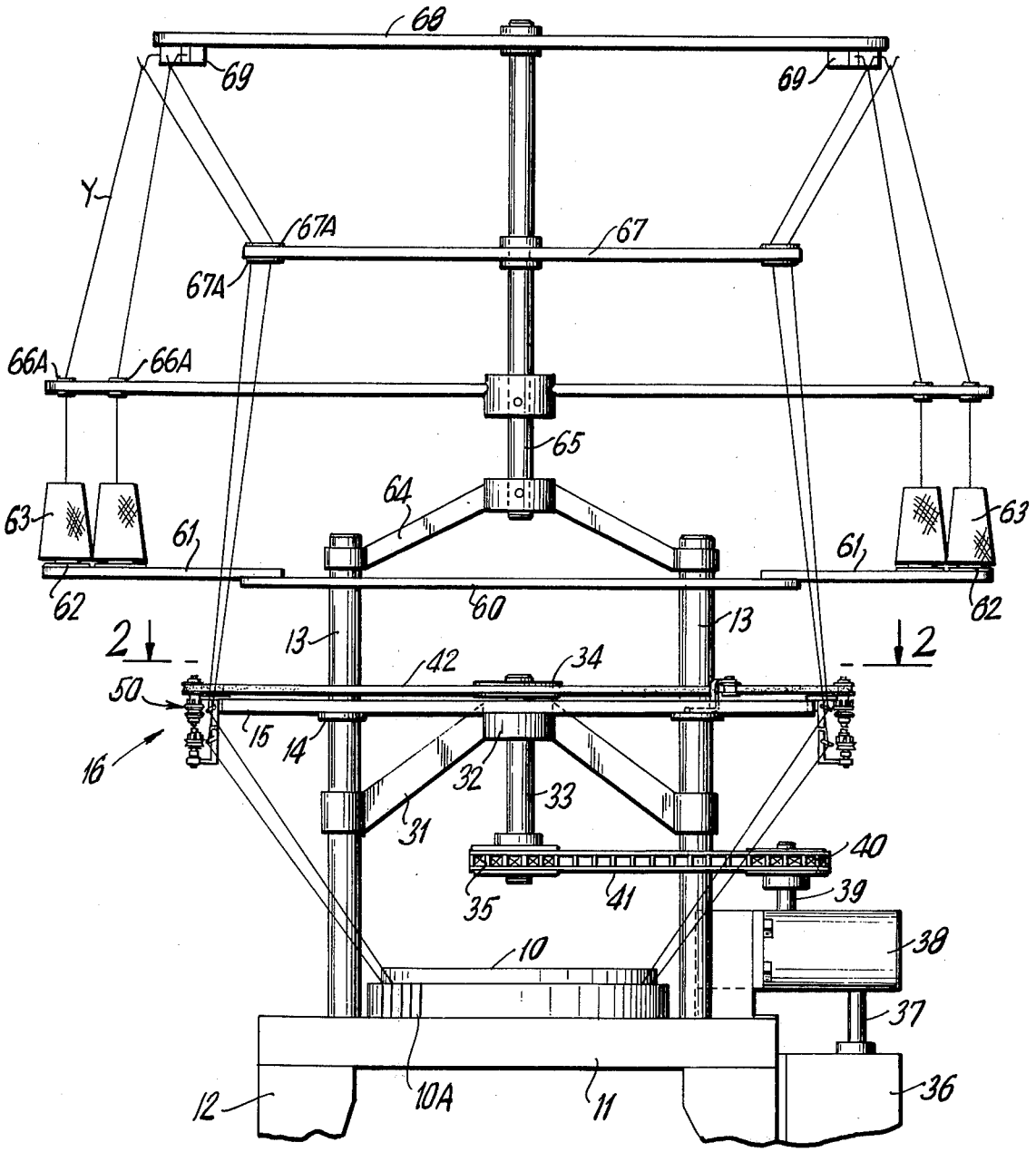
FIG. 1 is a diagrammatic side elevation showing the apparatus of the invention installed on the upper portion of a knitting machine, only several of the yarn cones and feeding devices being shown in the figure.

The yarn feeding apparatus of the invention is particularly intended to be used with a circular multifeed knitting machine for positively feeding yarns from a yarn source to the knitting stations of the machine and will therefore be described in connection with such a machine, although it can be used with any other type knitting machine or the like. As is well known, a circular multifeed knitting machine comprises one or more circular needle beds having a plurality of circumferentially spaced apart knitting stations at which yarn is fed to and knitted by the needles. Each knitting station, or yarn feed as it is frequently called, includes the needle actuating cams necessary for that station, guide means for guiding the yarn to the needles, together with other elements appropriate thereto. In such machines the needle bed or beds may be stationary with the needle cams rotating to actuate the needles or, alternatively, the needle bed or beds may rotate with the knitting stations being stationary, the latter type being shown in the exemplary illustrated embodiment. Since the knitting machine may be of any conventional design and an explanation of its detailed structure is not necessary to an understanding of the invention, the knitting machine and the knitting stations will not be further described and will only be diagrammatically shown.

Referring to FIGS. 1–5, a circular multifeed knitting machine 10 having one or more circular needle bars and a plurality of circumferentially spaced apart stationary knitting stations or yarn feeds 10A is centrally mounted on a table 11 which is supported by the machine frame or stand 12 of which only a segment is shown. A plurality of circumferentially spaced apart upwardly directed vertical support posts or standards 13 are mounted on the table around the machine, each post having secured thereto the inner end of an outwardly directed radial arm 14, the outer ends of said arms being secured to and supporting a horizontal mounting ring 15 which circumscribes the posts. A plurality of circumferentially spaced apart yarn feeding assemblies 16 are mounted on the mounting ring, each assembly including a U-shaped hanger bracket 17 for supporting the other elements of the assemblies.

Each bracket 17 has a vertical central branch 18 from whose ends depend two vertically spaced apart opposed lateral arms 19 and 20, each arm having a vertically bored circular enlargement 21 at its outer or free end. The bracket also includes an inverted L-shaped hanger or hook 22 constituted by horizontal hanger arm 23 depending from the upper end of the central branch in the direction away from lateral arm 19 and a vertical hanger arm 24 depending downwardly from the end of the horizontal arm, the vertical arm opposing the central branch and spaced therefrom to provide a downwardly opening space 25 slightly wider than the thickness of the mounting ring 15. Each bracket, supporting the other elements of the assembly, is suspended or hung from the mounting ring at its selected circumferential location by means of the hanger, the mounting ring being received in space 25. A plurality of set screws 26, in threaded engagement in horizontal bores in the vertical hanger arm, fix the bracket to the mounting ring at the desired location. The bracket may be a unitary metal casting. Each hanger can be hung from the mounting ring either with the lateral arms directed toward the knitting machine as illustrated, or with the lateral arms being directed away from the machine (not shown).

A bearing 27 is seated in the vertical bore in each circular enlargement 21. The bearings 27 in the opposed arms 19 and 20 are vertically aligned for receiving and rotatably mounting the vertical shaft 28 of the assembly, the upper end 29 of the shaft projecting above the upper surface of upper arm 19. An assembly pulley 30 is fixedly secured to the upper end 29 of the shaft whereby rotation of the pulley will rotate the assembly shaft. The remaining elements of the feeding assembly will be later described.

A yoke 31 mounted on posts 13 supports a bearing hub 32 generally centrally over the machine 10. A vertical drive shaft 33 is journalled in hub 32 with the shaft ends extending above and below the hub, a main or belt driving pulley 34 being fixedly secured to the upper end of shaft 33 and the sprocket wheel 35 being fixedly secured to the lower end of the shaft.

A knitting machine drive 36, diagrammatically shown, mounted on the machine frame, is the power source for driving the knitting machine and for driving the positive feeding mechanism. As is well known, the knitting machine drive operates the machine to cause the machine to knit at the knitting stations. If the machine is the type wherein the needle beds are stationary and the knitting cams rotate, the machine drive causes rotation of the cams and, when the machine is the type wherein the needle beds rotate and the cams are stationary, as in the illustrated embodiment, the machine drive rotates the needle beds. The machine drive drives a power takeoff shaft 37 which in turn drives a variable speed regulator 38, diagrammatically shown, having an output shaft 39 which has a sprocket wheel 40 mounted on the outer end thereof. Regulator 38 transmits the power from takeoff shaft 37 to output shaft 39 and determines the rotational speed of shaft 39 relative to that of shaft 37. The regulator permits the operator to adjust or vary the rotational speed of shaft 39 relative to that of shaft 37, and any conventional variable speed regulator may be used, preferably one which permits the relative speed of the two shafts to be adjusted over a continuous range.

An endless chain 41 is trained around sprockets 35 and 40 to transmit power from output shaft 39 to driving shaft 33 which in turn drives driving pulley 34. An endless belt or band 42 is trained around belt driving pulley 34 and all the assembly pulleys 30 whereby rotation of the driving pulley causes the belt to drive and rotate each of the assembly pulleys 30 and the shafts 28.

The machine drive therefore drives the knitting machine and also simultaneously drives assembly shafts 28 through a continuous power train successively consisting of power take-off shaft 37, variable speed regulator 38, output shaft 39, sprocket 40, chain 41, sprocket 35, driving shaft 33, driving pulley 34, belt 42, and assembly pulleys 30. In this manner all the elements of the power train and shafts 28 are driven synchronously with the operation of the knitting machine. In other words, starting, speeding up, slowing down, or stopping the machine drive causes the machine operation and the rotation of assembly shafts 28 to correspondingly start, speed up, slow down, or stop.

A horizontal plate 43 is supported by two adjacent posts 13, the plate having a longitudinally extending slot 44 therethrough. Idler arm 45 is slidably mounted on plate 43 by means of bolts 46 which freely pass through slot 44 and are in threaded engagement with threaded bores at one end of arm 45. An idler roller 47 is rotatably mounted at the free end of arm 45, said roller lying in the plane of belt 42. The idler arm can be slid along plate 43 to bring the idler roller into appropriate pressure contact with the belt to adjust the tension in the belt, the bolts being tightened to fix the position of the arm when the tension in the belt is adjusted as desired.

Figure 2:
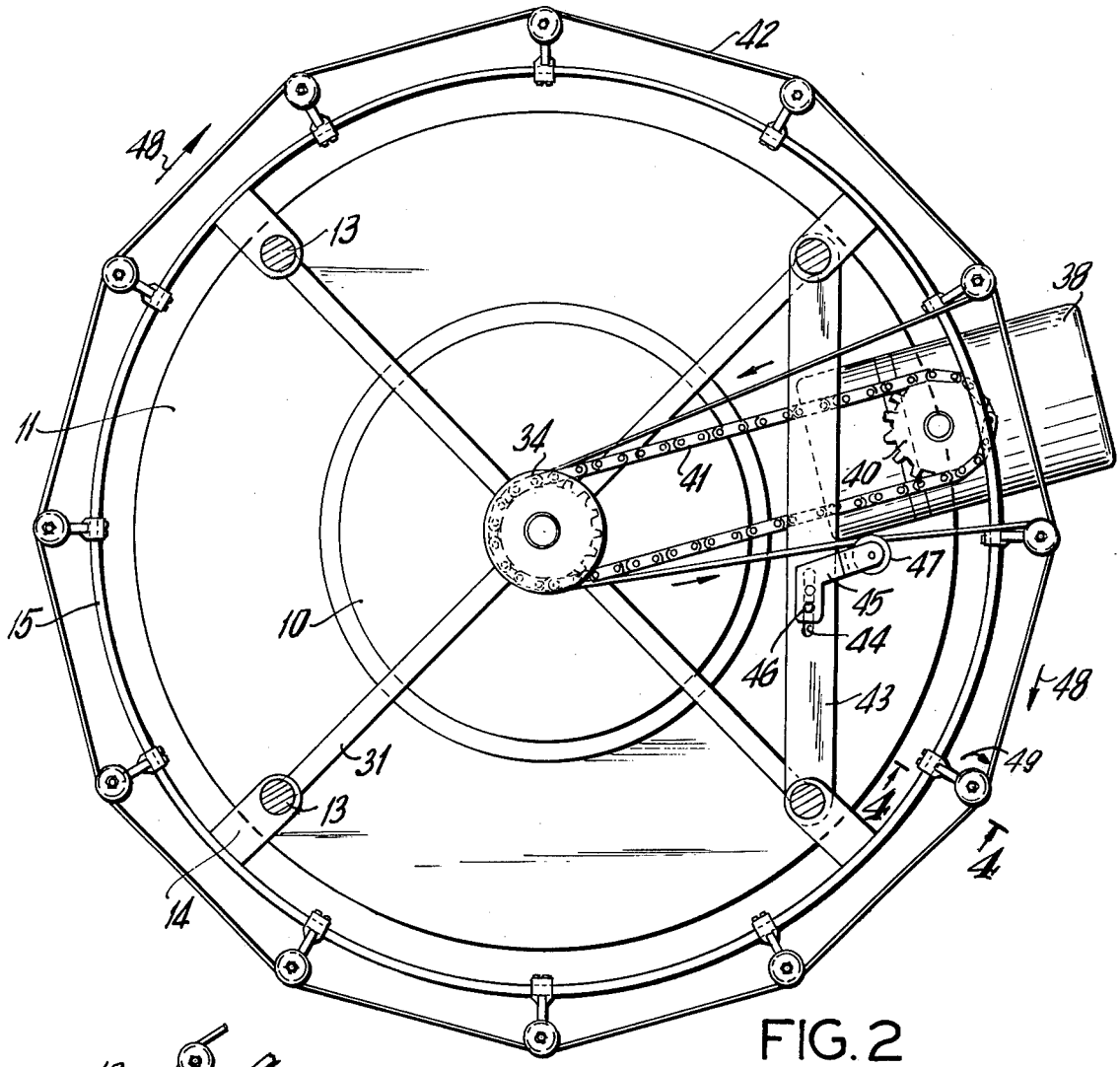
FIG. 2 is a diagrammatic fragmentary cross section taken along the line 2—2 of FIG. 1 on a slightly enlarged scale.
Figure 3:
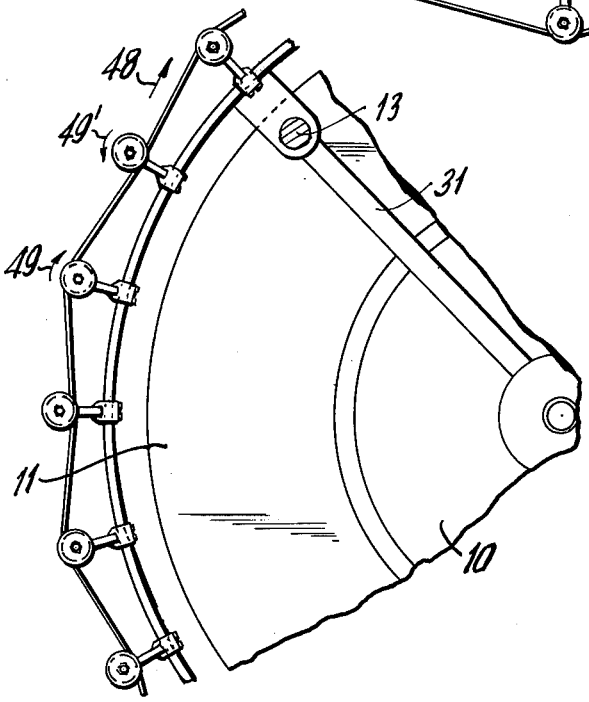
FIG. 3 is a fragmentary section corresponding to a portion of FIG. 2, showing an alternative embodiment wherein the belt which drives the feeding devices is arranged somewhat differently from that of the embodiment of FIG. 2.

Belt 42 can be trained around driving pulley 34 and assembly pulleys 30 in any convenient arrangement and two such arrangements are shown in FIGS. 2 and 3. In both arrangements the machine drive rotates driving pulley 34 counterclockwise, as viewed in these figures, the main portion of the belt trained around pulleys 30 rotating in a clockwise direction as shown by arrow 48. In the arrangement shown in FIG. 2 the belt contacts each pulley 30 on the portion of the rim thereof remote from the mounting ring 15 and therefore all the pulleys 30 rotate in the clockwise direction as indicated by arrow 49. In the arrangement shown in FIG. 3 the belt zigzags in its path around pulleys 30 so that the belt makes contact with alternate pulleys 30 on the portion of the rim remote from the mounting ring to rotate those pulleys in the direction of arrow 49 and makes contact with the intervening pulleys 30 on the portion of the rim closer to the mounting ring to rotate the intervening pulleys in the counterclockwise direction, as shown by arrow 49'. The arrangement of FIG. 3 is preferred when it is desired to increase the contact surface between the belt and each pulley 30 to reduce the chance of relative slippage therebetween, and therefore this arrangement is preferred when an increased number of yarn feeding assemblies is used. It is noted that all the pulleys 30 do not have to rotate in the same direction and that the drive train can be arranged to rotate driving pulley 34 in the same direction as the needle beds rotate or in the opposite direction.

The variable speed regulator 38 permits the operator to vary the rotational speed of the belt relative to the rotational speed of the needle bed. In the event the regulator does not provide a sufficient range of adjustment, further adjustment can be obtained by using as the drive pulley 34 an adjustable diameter pulley such as one shown in U.S. Pat. No. 3,243,091, for example. In the illustrated embodiment, all the pulleys 30 have the same diameter and therefore they all rotate their respective shafts 28 at the same rotational speed. Alternatively (not shown), one or more pulleys 30 may have a different diameter from that of other pulleys 30 and in this manner one or more shafts 28 can be caused to rotate the speeds different from other shafts.

In addition to the elements previously described (bracket 17, bearings 27, shaft 28 and pulley 30), each yarn feeding assembly 16 also includes one, two, three, or more yarn feed units 50 (specific units which are later described in detail by way of example being identified by an alphabetical suffix such as 50A, 50B, etc.) mounted on each assembly shaft 28 for rotation therewith about the shaft axis and one yarn guide holder 51 for each feed unit. The feed units will be later described in detail. Although all the asssemblies do not have to contain the same number of feed units, in the illustrated embodiment each feed assembly contains two feed units 50.

Each yarn guide holder 51 is pivotally mounted on central branch 18 of bracket 17 adjacent its corresponding feed unit to constitute means for directing or guiding yarn from a yarn source to said feed unit and for directing or guiding yarn from the feed unit toward the knitting machine.

The guide holder 51 (see FIGS. 4, 5, 6 and 12) is so shaped that it can be easily made, by cutting and bending, from a single piece of metal. The holder 51 is composed of two spaced apart opposed guide arms 52A and 52B connected by a cross arm 53 generally centrally the length and width of the guide arms, thereby providing a cutout 52A' on guide arm 52A below the cross arm and a cutout 52B' on guide arm 52B above the cross arm. The inner ends of the guide arms are disposed on opposite sides of central branch 18 and are secured to the ends of a horizontal bolt or pintle 54 rotatably mounted in a horizontal bore through the central branch so that the guide holder is swingable about the axis of the pintle 54. The guide arms extend toward the yarn feed unit and the inner edge 53A of the cross arm is spaced from the inner surface of the central branch. Each guide arm 52A and 52B terminates in an outer or free end 55A and 55B, respectively, each free end being inclined away from that of the opposed arm. At least one yarn guide or eyelet 56A is mounted in free end 55A and at least one yarn guide or eyelet 56B is mounted in free end 55B.

Figure 13:
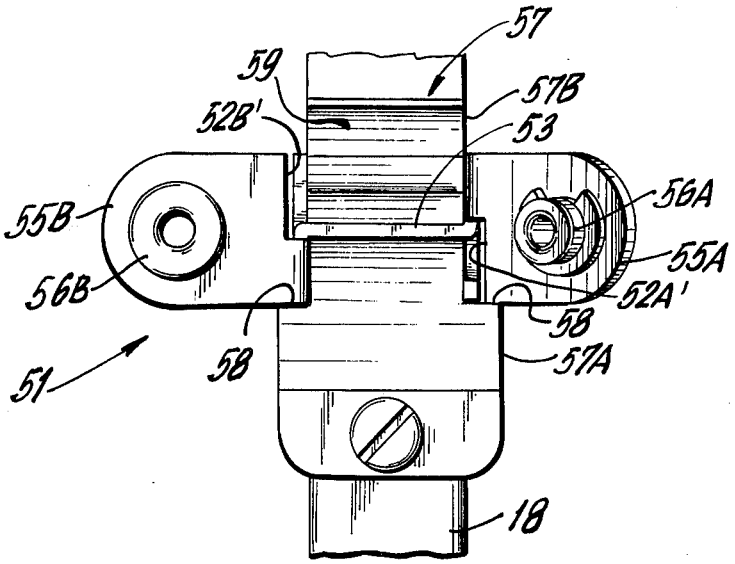
FIG. 13 is a front elevation of the spring catch for holding the guide holder in its desired position.

The yarn guide holder is selectively swingable about the axis of pintle 54 between an operative or feeding position, which in the illustrated embodiment is the lower position shown in solid lines in FIG. 4 and a neutral or non-feeding or inoperative position, which in the illustrated embodiment is the upper position shown at 51' in broken lines in FIG. 4. Any convenient means can be provided for selectively releasably maintaining the holder in either the operative or neutral position as desired. In the illustrated embodiment, such means is constituted by a spring detent or catch 57 made from a flat piece of spring steel (also see FIG. 13). The lower portion 57A of the catch is wider than the upper portion 57B of the catch to provide the catch with laterally extending shoulders 58 at the junction of the upper and lower portions. The width of the upper portion 57B does not exceed the spacing between opposed guide arms 52A and 52B of the guide holder while the width of lower portion 57A does exceed the space between the guide arms. The lower extremity of the catch is bolted onto the inner surface of the central branch of the bracket with the catch extending upwardly. The shoulder 58 is so located that when the guide holder is in the lower or feeding position the lower edges 53' and 53'' of the holder will rest on the shoulders of the catch to thereby prevent the catch from pivoting to a lower position. The upper portion 57B passes upwardly between the guide arms and between cross arm 53 and the central branch. The resiliency of the catch constantly urges the upper portion away from the central branch and against the inner edge 53A of the cross bar. In this manner the resiliency of the catch constantly urges the guide holder downwardly into abutment with shoulders 58 when the guide holder is in the feeding position. In this manner the guide holder is firmly maintained in the feeding position.

On the upper portion 57B the catch 57 is provided with a bend forming a laterally extending recess or pocket 59. The pocket 59 is so located that when the guide holder is moved to an upper neutral or non-feeding position (such as shown at 51'), the cross arm 53 will be received in such pocket and the guide holder will thereby be releasably maintained in the neutral position. From the foregoing description it is apparent that the guide holder can be easily snapped from its lower position to its upper position, and vice versa.

It is noted that free end 55A is inclined at about an angle of 45° relative to its arm 52A and that free end 55B is bent at about an angle of 90° relative to its arm 52B. As will be readily apparent from FIG. 5, this positions guide 56A closer to the yarn feed unit than guide 56B is positioned. As will be described later, the yarn from the yarn source passes through guide 56A before it passes through the feed unit and guide 56B so that guide 56A is the upstream guide. Best results are obtained when the upstream guide is close to the feed unit with the closeness of the downstream guide not being as important. As viewed in FIG. 5, guide 56A is clockwise relative to guide 56B and the feed unit rotates in the clockwise direction. If it is desired to rotate the feed unit in a counterclockwise direction, the guide 56A should be located counterclockwise relative to guide 56B. In other words, the relative positions of guides 56A and 56B should be reversed from that shown in FIG. 5. Guide holder 51 is so constructed that this reversal is easily accomplished by removing the bolt 54 and reversing the holder and then replacing the bolt.

The preceding description generally describes the yarn feeding apparatus. Any convenient arrangement can be used as the yarn source and one such arrangement is shown in FIG. 1. A yarn stand ring 60 is secured to and around posts 13 above endless belt 42, said ring supporting a plurality of outwardly extending radial arms 61 carrying upright yarn holders 62, and individual yarn supply in the form of yarn package or cone 63 being positioned in each holder. Posts 13 support a yoke 64 above driving pulley 34, said yoke supporting an upright 65 generally centrally over the knitting machine. The upright supports a plurality of radially extending guide arms 66, each guide arm having a plurality of yarn guides or eyelets 66A. A guide ring 67 having a plurality of yarn guides or eyelets 67A is mounted on the upright above guide arms 66. Near the top of the upright there is mounted a stop motion mounting ring 68 which supports a plurality of stop motion boxes 69, diagrammatically shown.

Each end of yarn Y flows downstream in its course successively from its respective yarn cone 63 through its respective guide 66A, through its respective stop motion box 69, through its respective guide 67A through upstream guide 56A of its respective guide holder 51, around its respective feed unit 50 and through downstream guide 56B of said guide holder toward and to its respective knitting station or yarn feed 10A. During operation of the machine each end of yarn travels downstream in the direction of the arrows thereon. "Upstream" and "downstream", when used in connection with elements or locations, are relative terms, and refer to relative distances along the path of yarn flow, "upstream" meaning closer to the yarn supply and "downstream" meaning closer to the knitting station. For example, guide 67A is upstream relative to its respective feed unit 50 because the yarn from the yarn cone flows through guide 67A before it flows into the feed unit 50, although feed unit 50 may actually by physically closer (outside of the yarn path) to the yarn cone than is guide 67A. Conversely, feed unit 50 is downstream relative to guide 67A.

The illustrated yarn source arrangement is a simple and conventional one in the art. Other and more complex arrangements may obviously be used. For example, the yarn packages may be mounted on a creel (not shown) instead of the yarn stand and, whether a creel or yarn stand be used, the yarn in its course to its guide holder may pass through one or more additional guides, tensioning devices, stop motion devices, etc. (not illustrated). Similarly, the yarn in its course from its guide holder to the knitting station may pass through various conventional knitting machine adjuncts such as guides, tensioning devices, stop motion devices, etc. (not shown)

A specific embodiment of yarn feed unit 50 will now be described in detail (see FIGS. 4 and 6–10), with reference to particular feed units 50A and 50B. Unit 50A is identical to unit 50B except that unit 50A is shown in the open feeding position and unit 50B is shown in the closed feeding position. Each feed unit 50 is constituted by a pair of toothed members in cooperating relationship, the pair of toothed members of each unit 50A and 50B being toothed wheels or discs 70 and 71.

Figure 6:
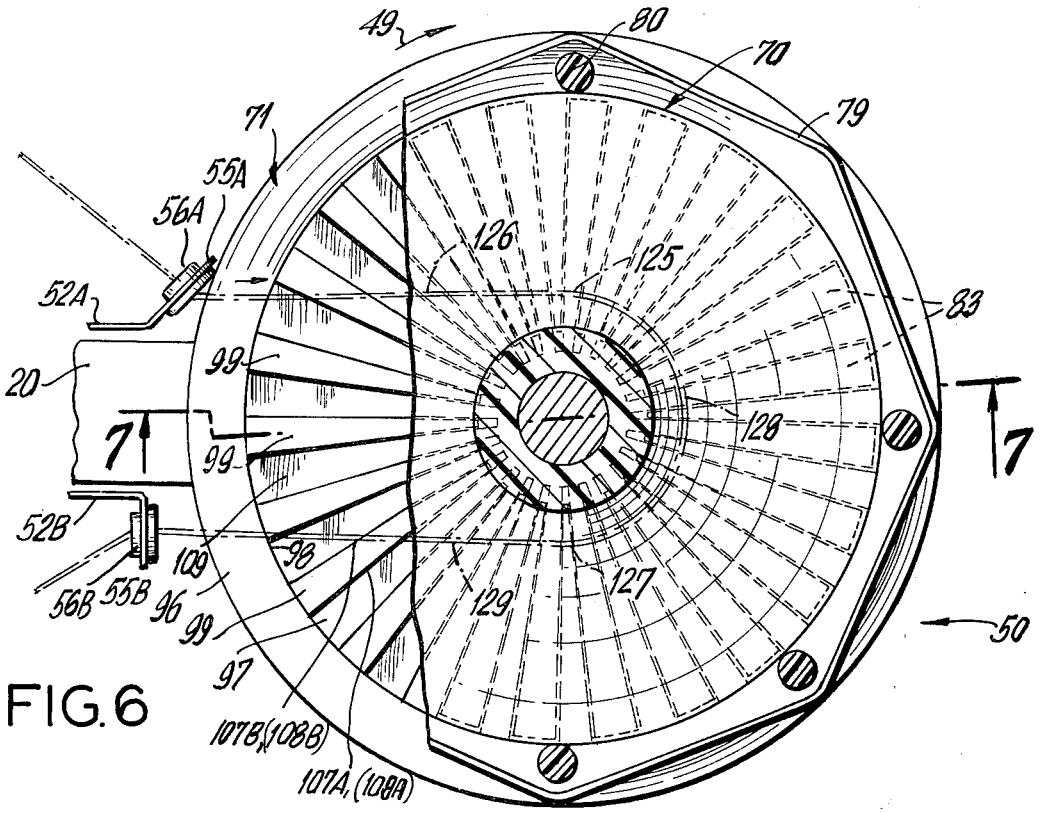
FIG. 6 is a fragmentary cross section taken along the line 6—6 of FIG. 4 at approximately twice the scale of FIG. 4.
Figure 9:
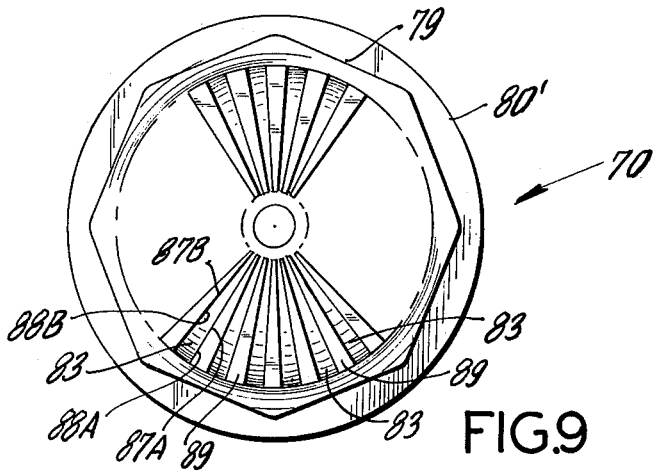
FIG. 9 is a front elevation of the upper toothed wheel of the embodiment of FIGS. 7 and 8.
Figure 12:
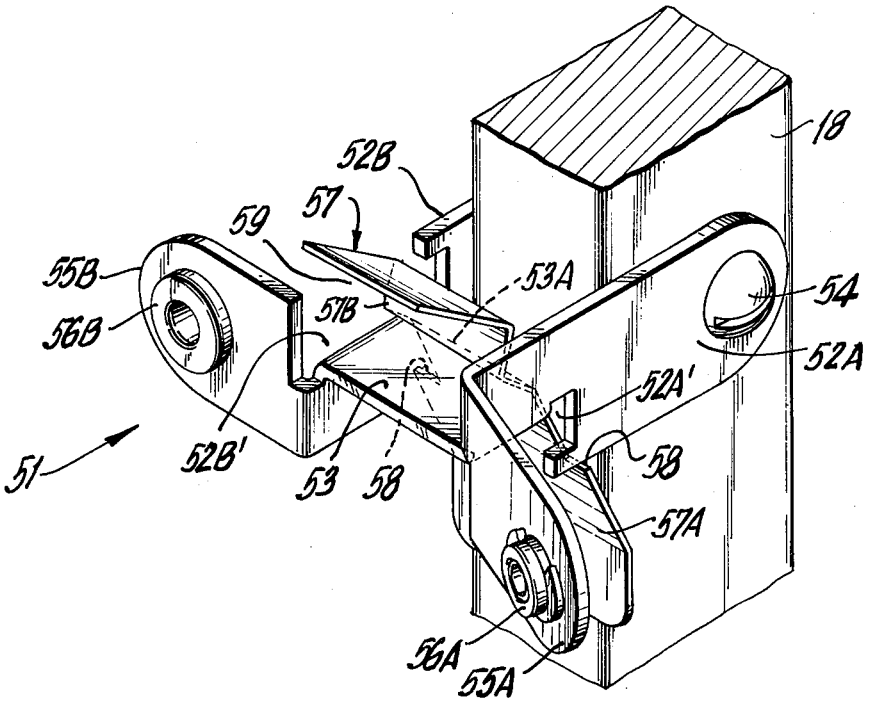
FIG. 12 is a perspective view of a guide holder.

Wheel 70 comprises a substantially frustoconical forwardly flaring annular body portion or web 72 circumscribing and depending outwardly and forwardly from the periphery of the forward end of a rearwardly projecting central axial hub 73 having an axial bore 74 therethrough for slidably receiving shaft 28, said web, hub and bore being coaxial. A substantially frustoconical rearwardly flaring annular lip or brim 75, coaxial with the web, circumscribes and depends outwardly and rearwardly from the outer periphery of the web. The forward face or front 76 of the brim joins and merges into the front or forward face 77 of the web at the outer edge or margin 78 of the web front. The outer periphery 79 of the brim may be circular or any desirable shape but is preferably polygonal, and more preferably octagonal, as shown in FIGS. 6 and 9. A plurality of circumferentially spaced apart smooth rearwardly tapered posts 80 extend rearwardly from the rear surface of the brim adjacent to but a short distance inwardly of the brim periphery, there being a post at each peripheral vertex. A ring 80' is secured to the rear end of post 80, the outer periphery of the ring outwardly overhanging the posts.

The flat forward face of hub 73 is comprised of an annular inner or shoulder face portion 81 surrounding the bore and an annular outer face portion 82 concentric therewith. A plurality of circumferentially spaced apart radially extending outwardly flaring forwardly projecting yarn engaging ribs 83 are disposed about the wheel axis and depend forwardly from web front 77 and outer face portion 82. Each rib begins at the outer periphery of shoulder face portion 81 and extends outwardly to about the web outer edge 78. The inner side 84 of each rib extends forwardly in a direction substantially parallel to the axis from the outer periphery of the shoulder face portion and terminates at about the plane defined by the web front margin 78. The circular array of inner sides 84 circumscribing the axis defines a space or counterbore 85 coaxial with and forwardly of axial bore 74.

The rib front or forward face 86 of each rib extends radially and flares outwardly from the forward edge of rib inner side 84 to about web outer edge 78 and preferably merging therewith. The rib fronts 86 lie in and determine a substantially planar annular surface circumscribing, and substantially perpendicular to, the axis. When, as shown in the drawing, the inner sides 84 of the ribs terminate in the plane defined by web outer edge 78, and the rib fronts lie in said plane, the surface determined by the rib fronts is a plane and is perpendicular to the axis. However, the inner sides 84 can extend slightly forwardly of the plane defined by web outer edge (not shown) or can terminate slightly rearwardly of the plane defined thereby (not shown), with the rib fronts, in either case, being slightly oblique to said plane. In such construction the surface determined by the rib fronts would be slightly frustoconical, either convex (rearwardly flaring) or concave (forwardly flaring), such surface still being considered as substantially planar and substantially perpendicular to the axis.

Figure 7:
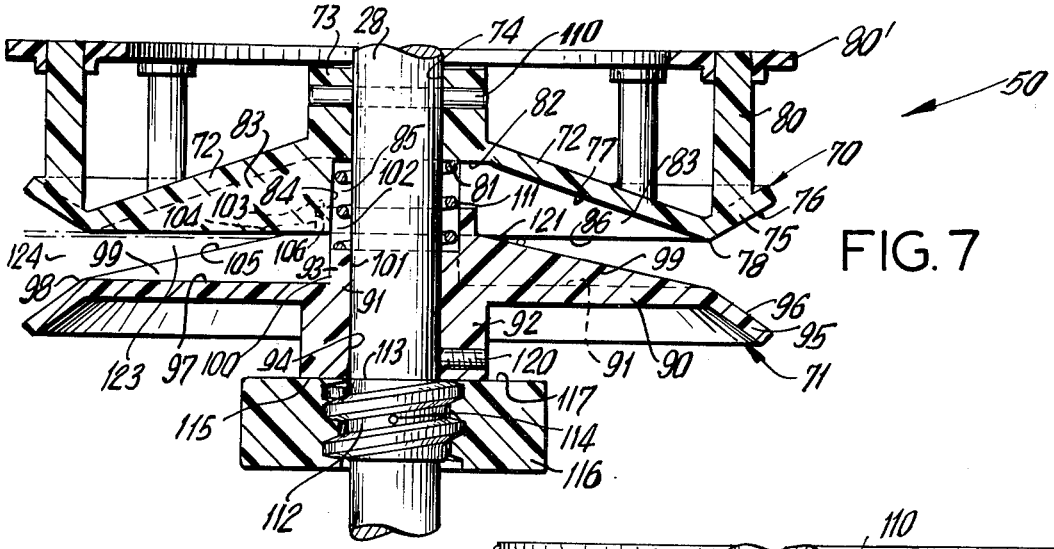
FIG. 7 is a cross section taken along the line 7—7 of FIG. 6 with parts broken away showing an embodiment of a feed unit of the invention in the open position.
Figure 8:
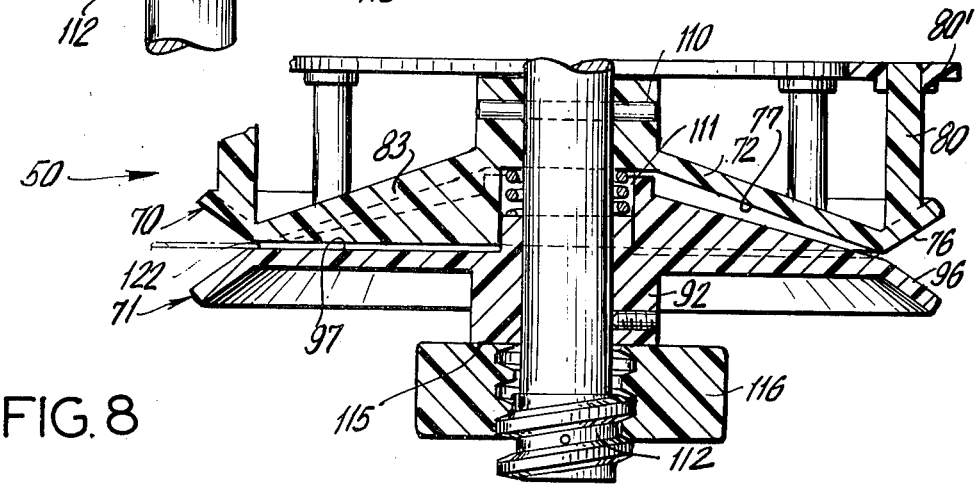
FIG. 8 is a cross section showing a unit similar to that of FIG. 7 but with the unit being in the closed position.
Figure 10:
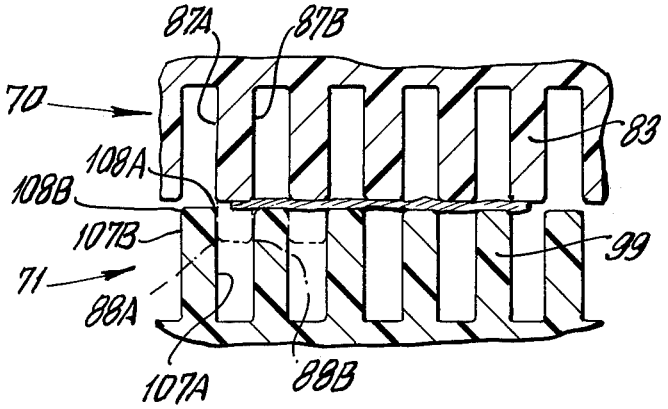
FIG. 10 is a developed front view looking inwardly into the feed unit through its mouth.

From the foregoing it will be appreciated that the longitudinal profile of each rib 83, as shown in FIGS. 7 and 8, is defined by the web front, the rib inner side, and the rib front and has substantially the shape of a right triangle whose hypotenuse defines the rear or base of the rib and whose longer leg defines the forwardly facing front 86. The height of the rib or any element thereof, at any particular location along the rib length, is the distance between the web front and the rib front measured in a direction parallel to the axis. The height of the rib therefore progressively decreases from a maximum near its inner end to a minimum at its outer end where the rib merges with the web front.

Each rib has circumferentially spaced apart lateral sides or flanks 87A and 87B which are substantially radially disposed and which extend forwardly from the web front 77 to the rib front 86, the junction of flanks 87A and 87B with the rib front forming substantially radially disposed, circumferentially spaced apart lateral rib edges or corners 88A and 88B, respectively. The width of the rib at any particular location along the length thereof is defined by the spacing between the flanks or lateral edges at that location. When viewed in front elevation (as shown in FIG. 9), flank 87B and lateral edge 88B of each rib are disposed clockwise relative to flank 87A and lateral edge 88A of said rib, and, conversely, flank 87A and lateral edge 88A of each rib are disposed counterclockwise relative to flank 87B and lateral edge 88B of that rib. Therefore, flank 87A and edge 88A will be called counterclockwise flank and edge, respectively, and flank 87B and edge 88B will be called clockwise flank and edge, respectively. The flanks extend forwardly from the web front in a direction substantially parallel to the axis, so that the transverse cross section of each rib of any location along the length thereof is substantially rectangular, the cross section increasing in width but decreasing in height as the cross section is taken closer to the outer end of the rib.

The front of wheel 70 is provided with a plurality of circumferentially spaced apart radially extending forwardly opening spaces or slots 89, equal in number to the ribs 83, the slots being formed by the circumferential spacing apart of the ribs so that each pair of adjacent ribs defines between them a slot, the ribs and slots alternating circumferentially about the wheel axis. Therefore, the spaced apart lateral sides of each slot are formed by flank 87B of the rib on the counterclockwise side of the slot and the opposed flank 87A of the rib on the clockwise side of the slot, the spacing between such opposed flanks of each pair of adjacent ribs defining between them the width of the slot. Stated differently, when viewed in front elevation, the counterclockwise lateral side of each slot is formed by a flank 87B and the clockwise lateral side of the slot is formed by a flank 87A. All the ribs 83 are of the same size and shape and all of the slots 89 are of the same size and shape. The inner end of each slot communicates with couterbore 85 and the outer end of each slot ends at web front outer edge 78.

Since the lateral flanks and edges extend substantially radially, the frontal shape of each rib and slot, namely, the shape when viewed in front elevation, is that of an outwardly flaring wedge, or, more precisely, substantially that of a sector of an annulus. In the illustrated and preferred embodiment, the circumferential spacing of the flanks 87A and 87B is such that the angle formed by adjacent flanks 87A and 87B (or edges 88A and 88B) when defining the width of a rib is slightly less than the angle formed by adjacent flanks 87B and 87A when defining the width of a slot. Each rib is therefore slightly narrower than each slot; in other words, the width of the rib is slightly less than the width of the slot at any particular radial distance from the axis.

Wheel 71 comprises a substantially planar annular body portion or web 90 circumscribing and depending outwardly from a central axial hub 91 coaxial therewith, the web being perpendicular to the axis. Hub 91 includes a rear cylindrical boss 92 projecting rearwardly of the web and a coaxial forward cylindrical hub portion 93 projecting forwardly of the web, the diameter of the forward hub portion being slightly less than that of counterbore 85 of wheel 70. The hub has an axial bore 94 therethrough for slidably receiving shaft 28. A substantially frustoconical rearwardly flaring annular lip or brim 95, coaxial with the web, circumscribes and depends outwardly and rearwardly from the outer periphery of the web. The front or forward face 96 of the brim joins and merges into the front of forward face 97 of the web at the outer edge or margin 98 of the web front, the diameter of outer edge 98 being about that of outer edge 78 of the web front of wheel 70. The outer periphery of the brim 95 may be any desirable shape and is shown as circular and having a diameter about that of the outer periphery 79 of the brim of wheel 70.

A plurality of circumferentially spaced apart radially extending outwardly flaring forwardly projecting yarn engaging ribs 99 equal in number to the ribs 83 of wheel 70, are disposed about the axis and depend forwardly from the web front 97. Each rib depends outwardly from the periphery of the forward hub portion 93 to about the outer edge 98 of the web. The inner side 100 of each rib extends in a direction substantially parallel to the axis from the periphery of forward hub portion 93 to project forwardly of the forward face 101 thereof. The circular array of rib inner sides 100 circumscribing the axis defines a space or counterbore 102 coaxial with, and forwardly of, axial bore 94.

The rib front or forward face of each rib is constituted by three surface segments or branches, the first segment being shoulder segment 103 extending outwardly from the outward end of inner side 100, the second being offset or guard segment 104 extending rearwardly in the direction substantially parallel to the axis from the outer end of the shoulder segment, and the third segment being the main inclined segment 105 extending obliquely outwardly and rearwardly from the rear end of the guard segment to about the web outer edge 98 and preferably merging therewith. It will therefore be apparent that the longitudinal profile of each rib 99, as shown in FIGS. 7 and 8, is defined by the web front, the rib inner side, and the rib front, said profile being substantially that of a right triangle whose hypotenuse faces forwardly, there being a small forwardly projecting tongue 106, at the inner end of the hypotenuse, formed by the guard segment, the shoulder segment, and the forward end of the inner side. The surface determined by the rib fronts is a convex or rearwardly flaring substantially frustoconical surface having a small annular forward projection at its forward and inner end formed by the tongues 106.

Each rib 99 has substantially radially disposed, circumferentially spaced apart lateral sides or flanks 107A and 107B extending forwardly from the web front 97 to the rib front, the junction of flanks 107A and 107B with the ribfront forming substantially radially disposed circumferentially spaced apart lateral edges or corners 108A or 108B, respectively. In front elevation, flanks 107A and edges 108A are counterclockwise flanks and edges, respectively, and flanks 107B and edges 108B are clockwise flanks and edges, respectively. The width of the ribs at any particular location along the length thereof is defined by the spacing between the flanks or lateral edges at that location. The flanks extend forwardly from the web front in a direction substantially parallel to the axis so that the transverse cross section of each rib at any location along the length thereof is substantially rectangular, the cross section increasing in width but decreasing in height as the cross section is taken closer to the outer end of the rib.

The front of wheel 71 is provided with a plurality of circumferentially spaced apart radially extending forwardly opening spaces or slots 109, equal in number to the ribs 99, the slots being formed by the circumferential spacing apart of the ribs so that each pair of adjacent ribs defines between them a slot, the ribs and slots alternating circumferentially about the wheel axis. Therefore, the spaced apart lateral sides of each slot are formed by flank 107B of the rib on the counterclockwise side of the slot and the opposed flank 107A of the rib on the clockwise side of the slot, the spacing between such opposed flanks of each pair of adjacent ribs defining between them the width of the slot. Stated differently, when viewed in front elevation, the counteclockwise lateral side of each slot is defined by a flank 107B and the clockwise lateral side of the slot is formed by a flank 107A. All the ribs 99 are of the same size and shape and all of the slots 109 are of the same size and shape.

The elements of the wheels 70 and 71 which are functional or operative in the engagement and feeding of the yarn are called teeth. As will be explained hereinafter, the fronts 86 of ribs 83, including the lateral edges 88A and 88B, and the main inclined segments 105 of the forward face of ribs 99, including lateral edges 108A and 108B, mutually cooperate to engage and feed the yarn. Therefore, in the illustrated embodiment, each rib front 86 defines a forwardly facing radially extending yarn engaging tooth 86 having lateral edges 88A and 88B and each main inclined segment 105 defines a forwardly facing radially extending yarn engaging tooth 105 having lateral edges 108A and 108B. The front face of each wheel therefore comprises a plurality of circumferentially spaced apart forwardly facing teeth disposed about the wheel axis, the spaces between the teeth of each wheel forming the slots thereof.

The circumferential spacing of flanks 107A and 107B of wheel 71 is the same as that of flanks 87A and 87B of wheel 70. Therefore, the frontal shape, namely, the shape when viewed in front elevation in a direction parallel to the axis, of each rib, tooth, and slot of wheel 71 is substantially the same as that of each rib, tooth, and slot, of wheel 70. As a result, the ribs and teeth of wheel 70 are slightly narrower than the slots of wheel 71 and the ribs and teeth of wheel 71 are slightly narrower than the slots of wheel 70. Because of these dimensions, the ribs and teeth of each wheel are meshable with the ribs and teeth of the other when the wheels are coaxially mounted with their front faces opposed and with the ribs and teeth of each wheel being superposed over and aligned with the slots of the other wheel, that is, when each rib 83 (and tooth 86) of wheel 70 is opposed to a slot 109 of wheel 71 and each rib 99 (and tooth 105) of wheel 71 is opposed to a slot 89 of wheel 70. When the wheels are so mounted, the axial spacing between the wheels can be reduced to cause the ribs and the teeth thereof of each wheel to be at least partially received depthwise within the slots of the other wheel so that the ribs and teeth of each wheel mesh with those of the other to a greater or lesser degree depending upon the axial spacing.

The wheels can be made of any suitable material such as plastic or metal, or combinations thereof. The material can be homogeneous throughout the wheel as it is in the illustrated embodiment, or it can vary through the wheel. For example, portions subject to greater wear can be made from harder material than other portions. They can be produced by conventional machining operations but are preferably produced by casting or molding and during the molding or casting operation inserts of different materials can be provided in any conventional manner.

In the foregoing description it was stated that the flanks of the ribs extend forwardly substantially parallel to the axis. Ideally, they can be precisely parallel to the axis, but this may render it difficult to remove the wheels from the die or mold. To minimize such difficulties the flanks of each rib are preferably slightly forwardly inclined toward each other so that the transverse cross sectional shape of the ribs is actually that of a forwardly tapering trapezoid, rather than a rectangle and the cross sectional shape of the slots is that of an outwardly flaring trapezoid. Furthermore, the surfaces 86 and 105 need not be precisely flat or planar, but can be slightly convexly or concavely curved in longitudinal cross section and/or transverse cross section. However, the foregoing slight variations in shapes are considered as tolerances falling within the description of the shapes of the ribs, slots and surfaces thereof, as previously set forth.

A pair of cooperating toothed members is assembled into a yarn feed unit with the aid of means for coaxially mounting said members with their front faces opposed in order to provide an assembled yarn feeding unit rotatable about the common axis and for varying the axial spacing between the members of the unit at least through a selected or predetermined operative or yarn feeding range throughout which the teeth of the members mesh and such means will now be described. At the start of such selected range, the axial spacing is such that the members are in an open yarn feeding position wherein the teeth of the members mesh to a predetermined degree for feeding yarn at a predetermined rate, and at the end of the range the axial spacing is such that the members are in a closed yarn feeding position wherein the teeth mesh to a greater extent than said predetermined degree for feeding yarn at a faster rate than said predetermined rate.

Referring to FIGS. 4, 7 and 8, wheels 70 and 71 of each feed unit are coaxially mounted with their front faces opposed to each other on shaft 28 for rotation therewith about the shaft axis, the shaft passing through the aligned axial bores 74 and 94 of the respective wheels. In the illustrated embodiment feed units 50A and 50B are part of the same assembly 16 and therefore wheels 70, 71 of both units are mounted on the same shaft. Wheel 70 is fixed to the shaft against axial movement relative thereto by transverse pin 110 force fitted in aligned transverse bores in the shaft and hub 73. Wheel 71 is adjustably slidably mounted on the shaft for axial movement along the shaft in a direction toward or away from the fixed wheel to selectively vary the axial spacing between the wheels. In the illustrated embodiment wheel 70 is the upper wheel and wheel 71 is the lower wheel but the feed unit can be mounted on the shaft in the inverted position (not shown) with adjustable wheel 71 being the upper wheel and fixed wheel 70 being the lower wheel.

A helical compression spring 111 surrounding the shaft is disposed between the two wheels in opposed counterbores 85 and 102, one end of the spring being seated on shoulder face portion 81 of the hub of wheel 70 and the other end being seated against the front face 101 of the hub of wheel 71, the length of the spring being such that the spring will continuously resiliently urge the movable wheel axially away from the fixed wheel at least when the axial spacing between the wheels is within the yarn feeding range.

An externally threaded collar 112 having a diameter less than that of rear boss 92 of wheel 71 and having a forward face 113, is mounted on the shaft rearward of boss 92 and is fixed to the shaft for rotation therewith and against axial movement by transverse pin 114 passing through aligned transverse bores in the threaded collar and shaft. Wheel 71 can be moved axially away from wheel 70 until the rear face 115 of boss 92 abuts the forward face 113 of the collar, such abutment preventing further movement and providing stop means defining the position of maximum axial spacing between the wheels. Preferably in this position the ribs of the wheels are still in meshing engagement. More preferably, in the position of maximum axial spacing, the axial spacing of the wheels is such that the teeth of the wheels mesh to an extent defining the start of the yarn feeding range, i.e., the open position. The length of the spring is preferably such that the spring is still under compression in the maximum axial spacing position.

An internally threaded collar or nut 116 is threaded onto externally threaded collar 112 until the forward face 117 of the nut abuts the rear face 115 of the box when the wheels are in the position of maximum axial spacing. Since wheel 71 is axially slidable along the shaft, rotation of the nut in the appropriate direction will move the nut toward wheel 70, and the abutment of forward nut face 117 and rear boss face 115 will urge wheel 71 toward wheel 70 against the force of spring 111, thereby reducing the axial spacing between the wheels. The nut can be rotated sufficiently to move wheel 71 at least through the entire feeding range; that is, at least sufficiently to reduce the axial spacing from that representing the start of the range (open position) to that representing the end of the range (closed position). Preferably, the end of the range coincides with the position of minimum axial spacing, which is the position wherein further movement of wheel 71 toward wheel 70 is prevented by stop means. In the illustrated embodiment (see FIG. 8), the stop means is constituted by the abutment of shoulder segment 103 of tongue 106 with shoulder face portion 81 of hub 73. Alternatively, the elements of the wheels can be so dimensioned that other surfaces (not shown) come into abutment to prevent further reduction of the axial spacing. The spring 111 can act as the stop means if it is so dimensioned that its coils mutually abut to prevent further reduction in the axial spacing when the wheels are at the position of minimum axial spacing.

Rotation of the nut 116 in the reverse direction will permit the spring to urge wheel 71 away from wheel 70 to increase the axial spacing between the wheels, and therefore the axial location of the nut determines the axial spacing between the wheels. The nut, by appropriate rotation, can be positioned to bring the wheels into any selected position in the feeding range, be the position the open position, or the closed position, or any partially open position intermediate thereof. Cooperating indicia, such as scale 118 and index 119 on the outer cylindrical surfaces of the nut and boss, respectively, may be provided to indicate the rotational position of the nut and therefore the selected feeding position of the wheels. The pitch of the cooperating nut and collar threads is preferably so selected that rotation of the nut slightly less than 360° will move wheel 71 through the entire feeding range. This will prevent misreading of the indicia, since any particular setting of the scale and the index will always indicate one selected feeding position. A transverse set screw 120 in a transverse threaded bore in the boss is provided to fix wheel 71 to the shaft for rotation therewith and against axial movement when the rotation of the nut has brought the wheels to the selected feeding position in the feeding range.

Forward hub portion 93 of wheel 71 has a diameter slightly smaller than that of counterbore 85 of wheel 70 to enable the forward hub portion to be received within the counterbore, thereby preventing abutment of the forward hub portion with the inner ends of teeth 86 as the axial spacing is reduced.

The yarn feeding unit is operative for feeding yarn through at least a predetermined or selected yarn feeding range of axial spacing during which the teeth of the wheels are meshing in cooperative relationship for positively feeding the yarn. Hereinafter, whenever reference is made to a yarn feeding range, it will refer to such a selected or predetermined yarn feeding range, unless the context clearly indicates otherwise. The range starts when the spacing between the wheels is such that the wheels mesh to the degree defining the open yarn feeding position, preferably substantially as shown in unit 50A in FIGS. 4, 6 and 7. The range ends when the spacing is such that the teeth mesh to the degree defining the closed yarn feeding position, preferably substantially as shown in unit 50B in FIGS. 4 and 8. In each intermediate position, of which there are an infinite number because the axial spacing is continuously variable, the length of the axial spacing is less than that at the range start and greater than that of the range end, the teeth meshing to a degree intermediate those of the open and closed positions. Each tooth of each wheel is disposed between, and adjacent to, two teeth of the other wheel so that each tooth is in the yarn feeding cooperative relationship with the two teeth of the other wheel adjacent thereto.

Because teeth 105 are outwardly and rearwardly inclined relative to teeth 86, in every feeding position each tooth crosses or intersects, at an outwardly opening angle, each adjacent cooperative tooth of the other wheel at a crossing or intersection 121. Stated differently, the lateral edge 88A of each tooth 86 crosses or intersects at an intersection 121 the lateral edge 108A of the adjacent cooperative tooth 105 on one side thereof, and lateral edge 88B of each tooth 86 crosses or intersects at an intersection 121 the lateral edge 108B of the adjacent cooperative tooth 105 on the other side thereof. The teeth mesh or overlap inwardly of the intersections and diverge, without meshing or overlapping, outwardly of the intersections. Since teeth 105 and the lateral edges thereof are oblique to the axis, the radial distance between the intersections and the axis depends upon the distance the wheels are axially spaced apart, and, therefore, the greater the axial spacing, the closer the intersections are to the axis and the lesser is the degree of meshing.

Each pair of intersecting cooperating teeth, and particularly the two cooperating lateral edges thereof, cooperate to form an outwardly opening substantially V-shaped yarn receiving nip or bite 122, each intersection 121 forming the point of the V and being the innermost point or root of its respective bite. The array of outwardly opening bites 122 around the axis defines an outwardly opening substantially V-shaped circumferential groove 123 around the rim of the feed unit, the groove being the space between the opposed front faces of the wheels outwardly of the intersections. The circular array of intersections or bite roots 121 around the axis defines the internal diameter or root of the groove, the innermost and narrowest portion of the groove. The bite roots 121 lie in and determine a circle perpendicular to and coaxial with the axis. It is apparent that this circle is the groove root as well as the intersection of the surface defined by teeth 86 with the surface defined by teeth 105. The diameter of the groove root varies inversely with the axial spacing of the wheels; as the axial spacing is decreased or increased, the diameter of the groove root respectively increases or decreases. At its outer extremity, the groove 123 merges into the outwardly opening annular mouth 124 defined by the divergent forward faces of brims 75 and 95.

In the open position of the feeding range, the axial spacing is such that the intersections 121 are outward of the inner ends of teeth 105 as well as of teeth 86 to provide at least a small but significant degree of meshing or overlap between the teeth inwardly of the intersections. Preferably, the intersections are adjacent the inner ends of teeth 105 and 86, substantially as shown in FIG. 7, wherein the intersections are about 1/16–⅛ inch outward from the inner ends of teeth 105, or guard segments 104 of ribs 99. In the closed position, the axial spacing is such that the intersections 121 are inward of the outer ends of teeth 86 as well as of teeth 105 to provide at least a small but definite portion of both the teeth 86 and 105 diverging and not meshing outwardly of the intersections, the teeth meshing inwardly of the intersections to a greater degree than they do in the open position. Preferably, the intersections in the closed position are adjacent to the outer ends of teeth 86 and 105, substantially as shown in FIG. 8, wherein they are about 1/16–⅛ inch inward from the outer ends of teeth 86 and 105, or margins 78 and 98.

In the preferred and illustrated embodiment, the wheels in the open position substantially as shown in FIG. 7 are in the position of maximum axial spacing, and the wheels in the closed position substantially as shown in FIG. 8 are in the position of minimum axial spacing. Depending upon the thickness of the yarn, as well as other factors, the dimensions of the elements of the feed unit can be so selected that the intersections in the open position are located further inwardly than as illustrated and/or are located further outwardly in the closed position, but such selection may cause problems, as will be later pointed out. The preferred described locations of the open and closed positions provide a practical maximum feeding range, utilizing substantially the entire length of the teeth. Obviously, the dimensions of the elements of the unit can be selected so that the intersections in the open position are located further outwardly than illustrated and/or further inwardly in the closed position, but such selection will reduce the feeding range relative to the length of the teeth.

The teeth, and the cooperating lateral edges thereof, of each cooperating pair of teeth intersect or cross each other at an intersection without necessarily touching each other. The relative width of the teeth and slots can be such that the cooperating lateral edges actually touch each other at the intersection, and such structure would be operative. However, such structure would require very careful and precise manufacture and therefore would be relatively expensive. Therefore, in the illustrated and preferred embodiment, the widths of the teeth and slots are such that the lateral edges which cooperate to form a bite are circumferentially spaced apart from each other a very small distance. In any event, the cooperating lateral edges must be sufficiently close to each other to form a bite, in all positions of the feeding range, capable of wedgingly gripping the yarn. Since the teeth, including the lateral edges thereof, are the only surfaces which cooperate in feeding the yarn, the depth of the slots is not a significant factor. The slots merely have to be sufficiently deep to enable receipt therein of the height of the ribs in all positions of the feeding range.

The manner in which an end of yarn Y is positively fed by its corresponding yarn feed unit will now be described with particular reference to FIG. 6. In FIG. 6, as well as in the other figures, the thickness of the yarn is shown on an enlarged scale relative to the other elements of the assembly for purposes of clarity. In actual practice, the diameter of the yarn relative to the elements of the assembly will be much smaller than shown in the drawings. The yarn Y in its course downstream from its yarn supply to its knitting station of the knitting machine passes through a first, or upstream, guide of guide holder 51, such as guide 56A; then passes through mouth 124 of its feed unit into the bite 122 positioned at initial feeding, or entry, location or station 125 of the yarn course, to thereby form incoming yarn reach 126; then passes, in the direction in which the feed unit will rotate (clockwise in FIG. 6 as indicated by arrow 49), from entry station 125 about the axis and arcuately around at least a circumferential portion of the V-groove 123 to the bite 122 positioned at final feeding, or discharge, location or station 127 of the yarn course, thereby forming yarn feeding reach 128; then passes from discharge station 127 out of the V-groove, through mouth 124 into a second, or downstream guide, such as guide 56B, thereby forming outgoing yarn reach 129; and finally passes from guide 56B toward the knitting station.

Yarn feeding reach 128 is the portion of the yarn which, at any particular moment during the rotation of the feed unit, is disposed in the positive yarn feeding section of the yarn course. This is the section wherein the yarn is positively drawn and conveyed and is that section of the course from entry station 125 to discharge station 127. The yarn feeding reach 128 is grasped by the bites 122 which at that particular moment are disposed or extend, in the direction of arrow 49, from station 125 to station 127, and in this manner the rotation of the feed unit draws and conveys the yarn from station 125 downstream to station 127. The bites 122 which at that particular moment are disposed in the yarn feeding section constitute that portion of the feed unit which is active in feeding the yarn at that moment.

During the feeding process the yarn Y is under tension and as is apparent from FIG. 6, tension in the yarn will urge yarn feeding reach 128 toward the axis of the unit, and more particularly toward the root of the V-groove. It will be appreciated from the geometry involved that at entry station 125 incoming reach 126 is just about tangential to yarn feeding reach 128. As the unit rotates in the direction of arrow 49, as a bite approaches entry station 125, the yarn passes through that bite. However, the tension in the yarn does not create a force to urge the yarn toward the root of that bite sufficiently to cause the yarn to become grasped by that bite. However, as that bite reaches entry station 125 the force created by the tension in the yarn acts radially on the yarn to force the yarn into grasping engagement with that bite. As will be described later on, the yarn becomes wedgingly engaged by that bite. Normally, the yarn will remain wedgingly engaged in that bite as long as no force is applied to the yarn which will tend to urge the yarn radially outward from the axis. If the aforesaid bite is arbitrarily called the first bite, we can arbitrarily call the next bite adjacent thereto in a counterclockwise direction the second bite, the one next following the third bite, etc. When the first bite is at the entry station, the second bite has not yet arrived at that station and therefore does not wedgingly grip the yarn of incoming reach 126. As the unit rotates and said first bite moves clockwise toward discharge station 127 it draws the yarn through incoming guide 56A until the second bite arrives at the entry station. At that time the tension on the yarn will cause the yarn to be wedgingly gripped by the second bite. As the unit continues its rotation, the second bite draws the yarn through incoming guide 56A while the first bite merely conveys the yarn through the arcuate path in which the first bite moved. This process continues as each successive bite arrives at the entry station to wedgingly grip the yarn while the preceding bites continue toward discharge station 127 and convey the yarn through the yarn feeding course.

When the first bite arrives at discharge station 127 the tension in the yarn, and particularly in outgoing yarn reach 129, creates a force on the yarn in the first bite which urges the yarn outwardly from the axis and this causes the first bite to release or discharge the yarn. In actuality, as the first bite leaves the discharge station it pulls away from outgoing yarn reach 129 to cause release of the yarn. As each successive bite subsequent to the first bite arrives at the discharge station the yarn is successively released. The empty bites then continue their rotation in the direction of arrow 49 until they again arrive at entry station 125. It will be appreciated that discharge station 127 is located substantially at the point where outgoing yarn reach 129 is tangent to yarn feeding reach 128.

As has been pointed out previously, the yarn proceeds from guide 56B to its knitting station. At the knitting station the yarn is being consumed and this consumption of the yarn at the knitting station causes the yarn to be drawn through guide 56B and causes the tension in outgoing reach 129. In order for a positive feeding device to properly perform its function, it must draw the yarn from the yarn source and render it available to the knitting station at the same rate at which the knitting station consumes the yarn. In order for the positive feeding device to deliver yarn at the proper rate it is necessary to avoid relative slippage between the yarn and the yarn feed unit. One of the most important advantages of the present invention is that the yarn feed unit can draw from the source and positively feed it without any relative slippage. The teeth of the yarn feed unit are so constructed that the yarn will be wedgingly gripped by the bites without slipping. It is apparent that in order to avoid the slippage the yarn must always be wedgingly gripped by, and therefore under the control of, at least one bite, and preferably a plurality of bites. In other words, the circumferential spacing of the bites and the circumferential length of the yarn feeding section must be such as to always provide at least one bite, and preferably more than one bite, in the feeding section during the rotation of the feeding unit. Obviously, if the bites, for example, are angularly spaced apart 60° and station 127 is angularly spaced 45° from station 125, there will be moments when there is no bite in the feeding section to grip the yarn. At such times the yarn could freely slip through the feeding section at a circumferential speed different from that of the bites and this is obviously undesirable. In the illustrated embodiment, there are 24 teeth in each wheel and therefore there will be 48 bites, since each tooth cooperates to form bites with two teeth of the other wheel. This construction insures not only that there are always a plurality of bites in the yarn feeding section, but that there are sufficient bites to wedgingly grip the yarn in the event that some of the bites in the feeding section fail to wedgingly grip the yarn.

As will be pointed out later, the teeth are so constructed that the bites which they form are scissors-like bites and it has been surprisingly discovered that such scissors-like bites wedgingly grip the yarn so securely that there is normally no relative slippage between the yarn and the bite when the yarn tension is exerted tangentially to the bite, that is, exerted in a direction perpendicular to a wheel radius at the bite. As is readily apparent from FIG. 6, from the time the yarn is gripped at entry station 125 until the time it is discharged at station 127, the only force on the feeding portion of the yarn is tangential to the bite. It has been discoverd that with the range of knitting yarns used in a knitting machine, the bites wedgingly grip the yarn so securely that the yarn will tear before it will slip. It is only when the tension or pull on the yarn is exerted away from the root of the bite, as occurs at discharge station 127, that the yarn will be pulled away from the bite root and out of the grip of the bite.

In order to be certain that there is no slippage, it is preferred to have the yarn constantly gripped by more than one bite. In the preferred form of the invention, the feed unit is constructed so that there are always a plurality of bites in the feeding section and a plurality of bites will constantly grip the yarn.

It will be understood that the location of entry station 125, as well as the location of discharge station 127, may vary depending upon the setting, or axial spacing, of the feed unit. However, even for any particular setting of the unit, and/or for any particular spacing of guides 56A and 56B relative to the feed unit, and/or for any particular yarn, entry station 125 does not necessarily represent a single precise point, but rather identifies a range of locations in which successive bites grip the yarn. Discharge station 127 also represents a range of locations and, in fact, may represent a greater range than that represented by the entry station because the location of the discharge station is related to the uniformity with which the knitting station draws the yarn. A knitting station, when knitting a jacquard pattern, does not necessarily draw the yarn at a constant rate. In other words, the rate at which the yarn is consumed at a knitting station may vary from inch to inch, although the consumption perrevolution of the machine would be uniform. In all installations, however, the variation in the rate of consumption of yarn at the knitting station is substantially compensated for by the use of a spring arm on the stop motion device downstream of the positive feeding device which absorbs it. The effect of this spring arm is to substantially reduce the variation in the tension of the yarn downstream of the feeding device. However, when knitting a plain fabric (non-jacquard) there is no variation in the feeding rate.

Reference has been made to the intersecting teeth of the wheels of the unit as forming scissors-like bites. It will be appreciated that as the axial spacing between wheels 70 and 71 is reduced, the rib edge 88A (or 88B) of a rib of wheel 70 moves past its cooperating rib edge 108A (or 108B) of wheel 71 in a manner similar to the blade of a scissors of its cooperating blade. Of course, after the axial spacing has been set and the feeding unit is in operation, the axial spacing does not vary as the yarn is being fed. However, the cooperating edges of the teeth of the wheels bear a relationship to each other similar to that of a partially open scissors. The edges of the teeth are not maintained as sharp as the edges of the scissors blades. In fact, they should be smoothed off sufficiently to remove any burrs so that the cooperating edges will not tend to cut a yarn entering the bite. As is well known, a scissors will, when partially open, serve to grip in the nip a sheet or thread inserted therein. This is true even if the blades of the scissors are sufficiently dull so as not to cut into the material inserted therebetween. The bites formed by the teeth of wheels 70 and 71 in the same manner grasp the yarn when the tension on the yarn forces the yarn into the bite at the entry station. Two factors effect the ability of the bite to wedgingly grip the yarn at the entry station and to maintain such grip on the yarn until the bite arrives at the discharge station. One factor is the size of the angle between the teeth, and more precisely the edges thereof, which form the bite. In the illustrated embodiment, each tooth 86 (as well as the edges thereof) of wheel 70 form an outwardly opening angle of about 12° with each cooperating tooth 105 (and the edges thereof) of wheel 71. In other words, each tooth can be considered as being outwardly and rearwardly inclined at an angle of about 12° relative to its adjacent cooperative tooth of the other wheel. Note that this inclination is relative and applies even though each tooth of wheel 70 is perpendicular to the axis and each tooth of wheel 71 is oblique to the axis. Excellent results have been obtained when the angle between the teeth is substantially as illustrated, but good results can still be obtained when the angle between the teeth is increased or decreased. However, it is noted that the greater the increase of the angle, the greater the possibility of yarn slippage, and the greater the decrease of the angle, the greater the possibility of reduced uniformity in the rate of yarn feeding.

The other factor which effects the grip of the bite is the circumferential spacing between the cooperating edges of the teeth. As is well known by every user of a scissors, if the cutting edges of the blades are laterally spaced too far apart, the edges will not cut the material. If the lateral spacing between the blades is too great and the material to be cut is sufficiently flaccid or flexible, the material will pass between the opposed surfaces of the blades. The maximum permissible spacing to a great extent depends upon the material being handled. As in a scissors, the spacing between the cooperating edges of the present invention ideally should be as small as possible. However, as pointed out previously, it is difficult to manufacture the feed units and have the cooperating edges always contacting each other. It has been found that if the circumferential spacing between the cooperating edges does not significantly exceed the largest diametric dimension of the yarn being fed, the yarn will be wedgingly gripped by the bites.

Since it is difficult to set forth precise limits for the maximum desirable circumferential spacing between the lateral edges, it is convenient to define the scissors-like bite in a somewhat different fashion. The lateral spacing between the edges which form the bites should be such that the yarn feeding reach will not be pulled by the yarn tension inwardly toward the axis past the root of the bite. In other words, if a yarn under normal tension is moved transversely to its running direction radially toward the axis, the spacing between the edges defining the bite should be sufficiently small to prevent the yarn from passing inwardly of the bite root. If the spacing between the edges is sufficiently great that the yarn can pass the bite root, it will no longer be wedgingly gripped by the bite and therefore will not form a scissors-like bite.

Yarn feeding units made according to the present invention have been tested with varying types of yarns. The wheels of the tested units have a diameter of about 2½ inches and were constructed substantially as shown in the drawings. Each slot in each wheel was approximately 0.005 inch wider than the rib received therein. Excellent results were obtained with such units on varying types of yarn.

The axial spacing between the wheels is adjusted depending upon the rate of feeding desired. Since it is desirable that the spacing between the lateral edges of cooperating teeth be substantially the same regardless of the axial spacing, the cooperating lateral edges should preferably be substantially parallel to each other. These edges were previously described as extending substantially radially. Obviously, two cooperating edges cannot be parallel to each other and also be precisely radial. It is therefore understood that the lateral flanks which define the ribs are not necessarily all precisely radial.

The rate at which the yarn is fed is the rate at which the yarn is moved through the yarn feeding section and is proportional to the circumferential speed of the root of V-groove 123. If the yarn in the yarn feeding section were actually seated against the roots of the bites, the rate of feeding would be identical to the circumferential speed of the groove root. However, in actual practice the yarn is actually positioned slightly outwardly of the roots of the bites and therefore the speed of the yarn is slightly greater than the speed of the roots.

The present invention provides several principal methods, or techniques, for varying the rate of feeding the yarn. One method involves the rotational, or angular, speed of the bites by varying the speed at which assembly shaft 28 is rotated. This can be accomplished in several different ways. One way is to vary the speed of endless belt 42 and this will proportionately change the speed of all the feed units driven by the belt. The speed of the endless belt can be changed by changing the diameter of the driving pulley or by adjusting the variable speed regulator 38. As stated, such variation changes the speed of all the feed units driven by that belt. Another way to change the rotational speed of assembly shaft 28 is to change the diameter of pulley 30 relative to the diameter of other pulleys. In this way the speed of all the feed units on a particular assembly shaft 28 can be changed relative to those on different assembly shafts.

The second principal technique for varying the rate of feeding involves varying the axial spacing of the feed unit whose rate of feeding is to be changed. Varying axial spacing varies the diameter of the root of V-groove 123. The greater the spacing between the wheels of a feed unit, the smaller the diameter of the groove root, and therefore the lower the feeding rate. Conversely, the smaller the spacing between the wheels of a feed unit, the greater the diameter of the groove root, and therefore, the higher the feeding rate. From the foregoing description of the invention, it is apparent that each feed unit on each assembly can have its axial spacing varied independently of the other units of its assembly, and/or of other assemblies. The present invention therefore provides a simple way of adjusting the feeding rate of each feeding station independently of the others. It is also emphasized that since the axial spacing can be varied continuously through a range, the rate of feeding can be adjusted precisely as desired. The two techniques for varying the rate of feeding discussed above may be used together, if desired.

It is noted that the circumferential length of the yarn feeding section, that is, the circumferential distance between entry station 126 and discharge station 127, does not effect the rate of feeding but merely controls the number of bites disposed along the yarn feeding section. In the illustrated embodiment, the yarn feeding section in FIG. 6 is about 180°. The angular length of the feeding section can encompass a greater or lesser proportion of the feed unit and can even extend up to and including the entire 360° of the unit.

Since, in the illustrated embodiment, the teeth of wheel 70 are substantially perpendicular to the axis, the root of V-groove 123 will not be displaced axially regardless of the axial spacing between the wheels. In other words, in the illustrated embodiment, regardless of the axial spacing, the groove root always lies in the plane defined by teeth 86. It is desired that the guides 56A and 58B be so positioned as to direct the yarn is substantially a straight line into entry station 125 and in substantially a straight line out of discharge station 127. Therefore, the guide holder 51 in the operative position as shown in solid lines in FIG. 4 should direct the yarn as close as possible to the front face of wheel 70. When so adjusted, it is not necessary to move the guide holder even when the axial spacing of the unit is varied to vary the rate of delivery of the yarn.

When it is desired that a particular feed unit is to be inactivated and not feed yarn, the yarn holder can be flipped to the inactive position shown in dotted lines at 51' of FIG. 4. This automatically raises the yarn and moves the yarn rearwardly of the front face of wheel 70 with the yarn then sliding around the posts 80. Even though the feed unit still rotates, no yarn will be fed because of the smoothness of the posts. The ring 80' at the rearward end of posts 80 prevents the yarn from moving rearwardly off the posts and becoming entangled. The polygonal shape of wheel 70 assists in the movement of the yarn when the guide holder is moved from the operative position to the neutral, or inactive, position, and vice versa. Although the feed unit would function well even if the periphery of wheel 70 were circular, such circular periphery might occasionally slow up the shifting of the yarn, either rearwardly or forwardly, when the guide holder is appropriately shifted. When the guide holder is in the operative, or feeding, position, it should preferably, as stated previously, direct the yarn as close as possible to the front face of wheel 70 but it should not direct the yarn so that either the incoming or outgoing reaches of the yarn contact the teeth outwardly of the bite. The guide holder 51 should preferably be so constructed that the upstream guide 56A is as close to the mouth 124 as possible while still permitting the guides to pass the periphery of wheel 70 as the guide holder is moved between the operative and the neutral positions.

In the embodiment thus far described, the teeth of wheel 70 are in a plane substantially perpendicular to the axis while the teeth of wheel 71 are at an oblique angle relative to the axis. According to the invention, it is only necessary that the teeth of the wheels are at an angle relative to each other so that as the axial spacing between the wheels is varied the diameter of the curve defined by the intersections also changes. Therefore, it is apparent that the teeth of both wheels may be substantially oblique to the axis and such an embodiment is illustrated in connection with feed unit 50C, shown in FIG. 11 using wheels 70' and 71'. In this embodiment the elements of the feed unit may be identical with those of previously described units 50A and 50B, with the exception of the differences which will now be pointed out.

The fixed wheel 70' differs from wheel 70 in that the inner side 84' of wheel 70' extends forwardly a greater distance than corresponding inner side 84 of wheel 70. As a result, the rib front 86' or tooth of rib 83' is rearwardly and outwardly inclined instead of being substantially perpendicular to the axis of shaft 28. Web 90' of movable wheel 71' is forwardly and outwardly inclined relative to the axis of shaft 28 instead of being substantially perpendicular to said axis as is web 90 of wheel 71. This change merely increases the depth of the slots between the ribs 99' of wheel 71' to accommodate the greater height of ribs 83' of wheel 70'. The rib fronts or teeth 105' are rearwardly and outwardly inclined relative to the axis of shaft 28. Wheel 70' may be fixed to shaft 28 be means of set screw 110' while wheel 71' may be adjusted axially by means of nut 116' whose structure may be similar to that of nut 116.

It was previously pointed out that the angle between teeth 86 and the cooperating teeth 105 is about 12°. Since teeth 86 are substantially perpendicular to the axis, teeth 105 will be inclined about 12° relative to the axis. If the same angular spacing is desired in the modification of FIG. 11, teeth 86' will be inclined about 6° to the axis and teeth 105' will also be inclined about 6° relative to the axis but in the opposite direction, thereby producing an overall angle of about 12° between the cooperating teeth.

Figure 11:
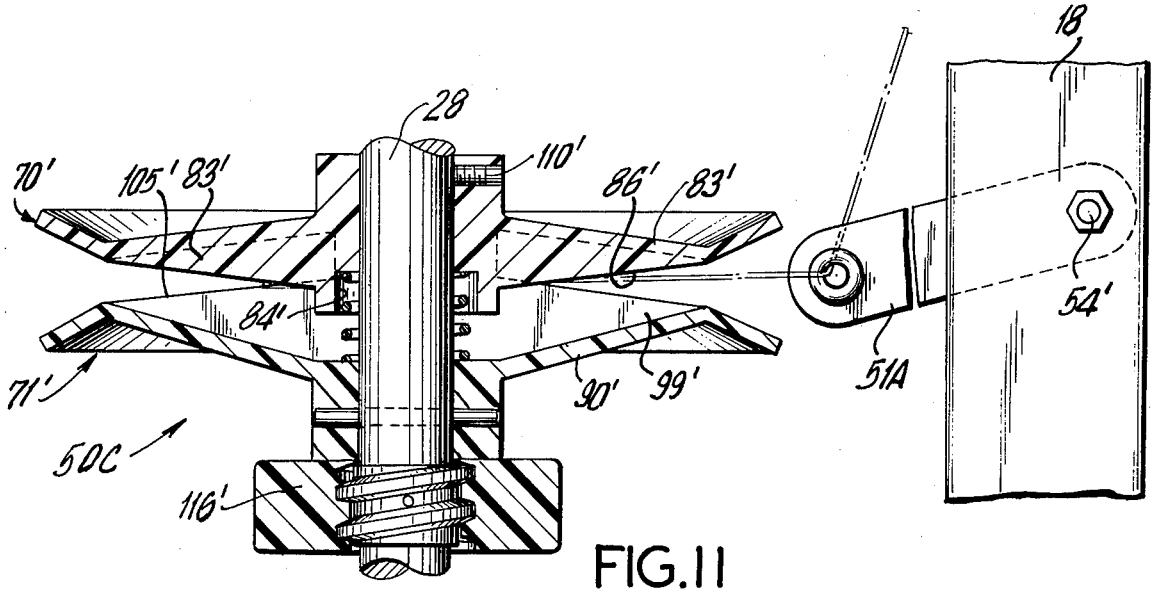
FIG. 11 is a cross sectional view of another embodiment of the feed unit of the invention.

In the modification of FIG. 11, the frontal shape of the ribs and slots of both wheels can be the same as that of wheels 70 and 71.

It will be apparent that as the axial spacing between wheels 70' and 71' is varied, the plane defined by the intersections of the teeth will lie in different axial locations. Since it is preferred that the yarn being guided to and from the feed unit by the guide holder (51A in FIG. 11) lie substantially in the plane of the intersections of the teeth, it will be necessary to adjust guide holder 51A whenever the axial spacing between the wheels is changed. Guide holder 51A can have the same construction as that of holder 51 but it should be provided with means for fixing it in the proper feeding or non-feeding position. A simple way of doing this is to mount guide holder 51A on a bolt 54' passing transversely through central branch 18 of the mounting bracket. The bolt 54A can be loosened to permit movement of holder 51A to the desired position and then tightened to maintain it in such position.

Although in the embodiment shown in FIG. 11 wheel 70' is fixed to the shaft and wheel 71' is axially adjustable along the shaft, it is apparent that wheel 70' may also be axially adjustable (not shown). In such a modification the operator can vary the axial spacing between the wheels by moving one or the other or both. If the operator would prefer that the plane defined by the intersections remain in the same axial location regardless of the axial spacing, the feeding adjustment of guide holder 51A can be fixed and the operator can adjust the axial spacing of both wheels to maintain the intersections in the plane aligned with the guide holder.

According to the preferred form of the invention, each tooth and each slot of each toothed member of the feed unit is so shaped that, at least through the feeding range, each tooth is received in the opposed slot between two adjacent teeth of the other toothed member and cooperates with said two adjacent teeth to form two circumferentially spaced apart bites. Such cooperation is obtained when the frontal shape of each tooth, at least in the zone of the unit where such teeth cooperate during feeding, is substantially the same as that of the opposed slot of the other member receiving such tooth. In other words, the configuration of the front face of each toothed member is substantially the complement of that of the other toothed member in at least such zone. For each location in one member which is occupied by a tooth, there is an opposed and corresponding location in the other member which is occupied by a slot substantially of the same frontal shape as that of the opposed tooth, and vice versa. Of course, for a tooth to be receivable within its opposed slot, the tooth must be slightly narrower than the slot to provide the necessary clearance and it will be understood that such condition prevails in the various configurations of teeth and slots under discussion. It was also previously pointed out that the cooperating lateral edges of opposed teeth may be slightly spaced apart as long as they are sufficiently close to provide a scissors-like bite and therefore it will be understood that in this discussion such spacing applies as well as the spacing necessary for clearance.

Within the foregoing concept, it is apparent that there are many possible configurations of teeth which will fullfil the preferred requirements. Some of these modifications will be briefly described but not illustrated. In one type of modification all the teeth and all the slots of both members flare outwardly with the lateral edges of the teeth extending substantially radially, the variations in the frontal shape resulting from variations in the angular width of the teeth and slots. The angular width of each tooth of one member can be the same as, or greater than, or less than, that of other teeth of that member. For example, all the teeth can have the same angular width or the angular width of each tooth can be different from that of each of the others, or each tooth may have the same width as one or more other teeth. Of course, the other wheel would be complementary in shape. In a similar manner, the angular width of each slot of one wheel can be the same as, or greater than, or less than, other slots of that wheel.

In the other types of modifications, all the teeth of one wheel need not flare outwardly. For example, in one wheel the teeth can be defined by substantially parallel edges, while the slots therebetween would flare outwardly. The cooperating wheel would, of course, be complementary in shape. In the illustrated embodiments, the edges of the teeth extend substantially radially and are substantially straight. Obviously, they need not be straight, nor need they extend substantially radially (not shown). It is only necessary that the edges of the teeth which cooperate be so shaped that as the axial spacing between the teeth decreases, the intersection of the cooperating edges moves outwardly relative to the axis, and vice versa.

Throughout the foregoing description, each tooth cooperated with the two adjacent teeth of the other wheel to produce two scissors-like bites and this result is produced whenever the front faces of the two cooperating wheels are complementary. However, the invention encompasses structures wherein a tooth may only cooperate for feeding yarn with one of the adjacent teeth of the other wheel. In other words, a tooth 86 may have its edge 88A sufficiently close to edge 108A of the tooth 105 on one side thereof to form a scissors-like bite. However, the same tooth 86 may have its edge 88B spaced apart sufficiently from edge 108B of the tooth 105 on the other side thereof as to not create a scissors-like bite. The edges defining the latter bite would not be considered to be in cooperative relationship for positively feeding yarn, and the teeth would not be considered as being in cooperative relationship.

It will be appreciated from the foregoing description that the effective parts of the feeding unit, insofar as the feeding of yarn is concerned, are the cooperating teeth including the lateral edges thereof. The particular shape of the teeth, the structure for mounting the teeth on their supports, etc., are not critical. In the illustrated embodiments the array of intersections in each position of the feeding range defines a circle and this is the preferred curve, but obviously the invention is not limited to such a curve.

It is also apparent that the axial spacing is adjusted to produce a desired rate of feeding. When the spacing is so adjusted the machine is then operated to perform its knitting function. Since the feed unit is driven in synchronism with the knitting machine, as previously described, when the speed of the knitting machine is changed, the rate of feeding is proportionately changed.

As the wheels are adjusted from the open position shown in FIG. 7 to the closed position shown in FIG. 8, the intersections of the teeth move outwardly in an annular zone surrounding the axis of the unit. The inner limit of the zone is defined by the intersections when the wheels are in the position of FIG. 7 and the outer limit of this zone is defined by the intersections when the wheels are in the position shown in FIG. 8. The intersections fall in various locations of this zone as the axial spacing is adjusted in the feeding range. Therefore, the portions of the teeth which fall in such annular zone are the portions which cooperate in feeding the yarn. It is the frontal shape of the teeth in at least this zone which determines the cooperation between the teeth of the wheels. Stated differently, the cooperating teeth in at least said zone are outwardly and rearwardly inclined relative to each adjacent tooth cooperative therewith to cause each of said teeth to intersect each tooth cooperative therewith at an outwardly opening angle at least through the range of axial spacing, thereby providing an outwardly opening substantially V-shaped circumferential groove around the assembled unit. The diameter of the groove will increase as the axial spacing decreases and vice versa. It is noted that the cooperating teeth mesh in at least said annular zone at least through the feeding range, or range of axial spacing. This does not mean that in each position of the feeding range the teeth mesh throughout the zone. It is apparent, of course, that in the closed position shown in FIG. 8, the teeth mesh through the entire width of the zone. However, in positions intermediate those shown in FIGS. 7 and 8, the teeth mesh only at the intersections and the portion of the zone inwardly of the intersections. It is noted that the teeth are considered meshing at the intersection so that in the open position of FIG. 7 the teeth mesh only at the innermost edge of the annular zone.

It was previously mentioned that the intersections in the open position can be located further inwardly than as illustrated in FIG. 7, or can be located further outwardly than illustrated in the closed position of FIG. 8, but that this may create problems. In the event the axial spacing is increased beyond that shown in FIG. 7, it might be possible for the yarn to slip inwardly past the intersection and become entangled on the shaft. This is obviously undesirable. In fact, it is just to prevent this possibility from occurring that guard segment 104 is provided on ribs 99 of wheel 71. These guard segments prevent any yarn which may happen to move inwardly of the intersetions from becoming entangled with the spring 111. Even when the open position is fixed, as shown in FIG. 7, yarn may occasionally move inwardly past the intersection because of defective teeth or other malfunction.

If the intersections are located further outwardly in the closed position than the location shown in FIG. 8, the yarn could be engaged by the smooth surface of the brims of the wheels, rather than the bites defined by the teeth. It is therefore desirable to have portions of the teeth extend outwardly from the intersections to provide a bite which can grip the yarn.

It will be appreciated from the description of the apparatus of the present invention that the invention also encompasses a method of feeding yarn. Broadly, the method comprises the steps of extending yarn in the yarn course from the yarn source to the knitting machine; repeatedly performing the operation of (a) wedging the yarn at a first or upstream location (the entry location) in the yarn course into a plurality of scissors-like bites to grip the yarn thereby, (b) moving the bites with the yarn gripped thereby downstream along said course to draw the yarn from the source and to convey the yarn downstream through a portion of the yarn course, and (c) then releasing the yarn from said bites at a location (discharge location) in the yarn course downstream from the first location; these repeated operations overlapping so that the yarn is being continuously gripped and conveyed by at least one bite to continuously maintain the movement of the yarn under the control of the bites. In this manner the yarn is positively fed by the moving bites with the bites being moved synchronously with the operation of the machine. It will be appreciated from the description of the apparatus that during the feeding operation the yarn is continuously being gripped by at least one bit in the yarn feeding section of the course but it is not always the same bite which is gripping the yarn. Of course, it is preferably being continuously gripped and conveyed by a plurality of bites to insure against slippage.

In the illustrated form of the invention, the repeated method operations are effected by cyclically moving a plurality of bites to grip, convey and release the yarn and these bites are moved in a generally circular path. The rate of feeding is changed by changing the speed of the bites along the path the bites move when gripping and conveying the yarn. This may be called the linear speed. Since the bites move in a generally circular path, the linear speed, and therefore the rate of feeding, can be changed by varying the angular speed of the bites and/or by changing the diameter of the circular path. When considering the diameter of the path of the bite, we are, in reality, considering the diameter of the path of the root of the bite.

I claim:

1. A method of positively feeding yarn of indefinite length from a yarn source to a knitting machine comprising the steps of:

a. extending said yarn in a course from a yarn source to said machine;

b. feeding said yarn in said course through a planar arcuate path;

c. while feeding said yarn through said planar arcuate path in said course repeatedly performing the operations of 1. wedging said yarn at a first location in said planar arcuate path into at least one scissors-like bite formed by an angular shaped rib means of a plurality of such rib means bites in said planar arcuate path to positively grip and hold said yarn from slippage relative to said rib means bite and said yarn course;

2. while gripping and holding said yarn from slippage relative to said bite and said yarn course moving said bites with said yarn grip thereby downstream along said planar arcuate path to draw said yarn from said source and to convey said yarn downstream through a portion of said course, and 3. releasing said yarn from said rib means bites at a location in said planar arcuate path downstream from said first location while wedging said yarn in said planar arcuate path upstream of said release location and at said first location into at least another one of said plurality of scissors-like bits formed by an angular shaped rib means;

c. said repeated operations overlapping so that said yarn is being continuously gripped, held and conveyed by at least one rib means bite to continuously maintain the movement of the yarn under the control of said bites, whereby said yarn is positively fed by said moving bites;

d. said bites, during said movement, being moved synchronously with the knitting operation of said machine.

2. A method according to claim 1, wherein said repeated operations overlap sufficiently for the yarn to be continuously gripped and conveyed by a plurality of bites.

3. A method according to claim 2, wherein said repeated operations are effected by cyclically moving a plurality of said bites to wedgingly grip, convey, and release said yarn.

4. A method according to claim 3, wherein said plurality of bites are cyclically moved in a generally circular path.

5. A method according to claim 4, wherein the rate of positive feeding is changed by changing the diameter of said circular path.

6. A method of simultaneously feeding a plurality of yarns to a knitting machine wherein at least some of said yarns are individually positively fed by the steps of:

a. extending said yarn in a course from a yarn source to said machine;

b. feeding said yarn in said course through a planar arcuate path;

c. while feeding said yarn through said planar arcuate path in said course repeatedly performing the operation of 1. wedging said yarn at a first location in said yarn course into at least one scissors-like bite formed by an angular shaped rib means of a plurality of such rib means bites to grip and hold said yarn from slippage relative to said rib means bite and said yarn course;

2. while gripping and holding said yarn from slippage relative to said bite and said yarn course moving said bites with said yarn gripping thereby downstream along said yarn course to draw said yarn from said source and to convey said yarn downstream through a portion of said course, and 3. releasing said yarn from said rib means bites at a location in said course downstream from said location while wedging said yarn in such yarn course upstream of said release location and at said first location into at least another one of said plurality of scissors-like bits formed by an angular shaped rib means;

d. said repeated operations overlapping so that said yarn is being continuously gripped, held and conveyed by at least one rib means bite to continuously maintain the movement of the yarn under the control of said bites, whereby said yarn is positively fed by said moving bites;

e. said bites, during said movement, being moved synchronously with the knitting operation of said machine.

7. A method according to claim 6, wherein the yarns have their rates of feeding independently adjusted.

8. A method according to claim 7, wherein some of said sets of bites are moved through a path of greater diameter than other of said sets of bites.

9. A method according to claim 7, wherein some of said sets of bites are moved at an angular speed different from other of said sets of bites.

10. A method according to claim 7, wherein at least some of said sets of bites are moved at the same angular speed and, of said sets moving at the same angular speed, some are moved in a path whose diameter is different from that of others.

11. A method according to claim 7, wherein the diameter of the movement path of each of said sets of bites is independently adjusted.

12. An apparatus for positively feeding yarn of indefinite length from a yarn source to a knitting machine comprising:

a. at least one yarn feed unit comprising a first toothed member and a second toothed member, each member having an axis and a front face;

b. each said front face comprising a plurality of circumferentially spaced apart forwardly operative yarn engaging teeth disposed about said axis;

c. said teeth of said first member being meshable with said teeth of said second member to position each said tooth of each member in cooperative relationship with at least one adjacent tooth of the other member so as to form therebetween angular shape rib means cooperating and forming scissors-like bite wedges for gripping, holding and positively feeding yarn through a planar path at said scissors-like bite wedges between said members;

d. means for coaxially mounting said members with said front faces opposed and said teeth meshing to provide an assembled, planar, arcuate yarn feed unit rotatable about the common axis of said members and for selectively varying the axial spacing between said members of said assembled unit at least through a selected range of axial spacing;

e. means for rotating said assembled unit about said axis;

f. said teeth of said assembled unit meshing at least in an annular zone of said assembly and forming said scissors-like bite wedges at least through said range of axial spacing;

g. each of said teeth, at least in said annular zone, being outwardly and rearwardly inclined relative to each adjacent tooth cooperative therewith to cause each of said teeth to intersect each tooth cooperative therewith, at least through said range of axial spacing, at an outwardly opening angle to provide an outwardly opening substantially V-shaped circumferential planar arcuate yarn receiving path around said assembled unit, the root of said angular path forming said scissors-like bite, the diameter of said root of said planar arcuate yarn receiving path increasing as the axial spacing between said members decreases, and vice versa; and h. means for directing said yarn from said source into said scissors-like bite of said planar arcuate yarn receiving path and around at least a portion thereof, and then out of said scissors-like bite and toward said machine;

i. whereby when said assembled unit is rotated, said scissors-like bite of said cooperating teeth engage, grip and hold said yarn in the planar arcuate path and draw the yarn from the source and positively feed the yarn toward the machine without slippage at said scissors-like bite between said yarn and said assembled unit.

13. An apparatus according to claim 12, wherein said teeth are so shaped and spaced that each of at least some of said intersections between cooperative teeth define a scissors-like bite for wedgingly receiving and gripping said yarn.

14. An apparatus according to claim 13, wherein said means for rotating said assembled unit rotates said unit synchronously with the operation of said machine.

15. An apparatus according to claim 14, wherein said apparatus comprises a plurality of said yarn feed units.

16. An apparatus according to claim 15, wherein the rate of feeding of each of said units is independently adjustable.

17. An apparatus according to claim 16, wherein the axial spacing between the members of each of said units is independently adjustable.

18. An apparatus according to claim 14, wherein in at least said annular zone, said teeth of said first member are oblique to said axis and said teeth of said second member are substantially perpendicular to said axis.

19. An apparatus according to claim 18, wherein said members are coaxially mounted on a common shaft for rotation therewith, said first member being axially fixed to said shaft and said second member being adjustably axially slidable along said shaft to vary the axial spacing between said members.

20. An apparatus according to claim 14, wherein the frontal shape of both of said members is substantially the same in at least said annular zone.

21. An apparatus according to claim 14, wherein, in at least said annular zone, the frontal configurations of said members are substantially complementary.

* * * * *